US010364090B2

(12) United States Patent
DeMatteis et al.

(10) Patent No.: US 10,364,090 B2
(45) Date of Patent: Jul. 30, 2019

(54) UNIVERSAL SPACE-SAVING ARTICLE DISPENSER

(71) Applicants: Robert DeMatteis, Grass Valley, CA (US); Lindsey Blevin, Eureka, CA (US)

(72) Inventors: Robert DeMatteis, Grass Valley, CA (US); Lindsey Blevin, Eureka, CA (US)

( * ) Notice: Subject to any disclaimer, the term of this patent is extended or adjusted under 35 U.S.C. 154(b) by 26 days.

(21) Appl. No.: 15/736,491

(22) PCT Filed: Jun. 17, 2016

(86) PCT No.: PCT/US2016/038219
§ 371 (c)(1),
(2) Date: Dec. 14, 2017

(87) PCT Pub. No.: WO2016/205735
PCT Pub. Date: Dec. 22, 2016

(65) Prior Publication Data

US 2018/0186552 A1 Jul. 5, 2018

Related U.S. Application Data

(60) Provisional application No. 62/285,574, filed on Oct. 30, 2015, provisional application No. 62/230,935, filed on Jun. 19, 2015.

(51) Int. Cl.

| | |
|---|---|
| ***B65D 83/08*** | (2006.01) |
| ***A47K 10/42*** | (2006.01) |
| ***B65D 83/00*** | (2006.01) |
| ***B65B 5/06*** | (2006.01) |

(52) U.S. Cl.
CPC ..... *B65D 83/0805* (2013.01); *A47K 10/42* (2013.01); *B65B 5/06* (2013.01); *B65D 83/00* (2013.01); *B65D 83/08* (2013.01); *B65D 83/0847* (2013.01); *A47K 2010/428* (2013.01)

(58) Field of Classification Search
USPC ..... 221/33–63; 229/53
See application file for complete search history.

(56) References Cited

U.S. PATENT DOCUMENTS 4,044,919 A * 8/1977 Olson ..... B65D 83/0852 221/63
4,175,673 A * 11/1979 McDonald ..... B65D 83/0805 221/63

(Continued)

*Primary Examiner* — Jacob S. Scott
*Assistant Examiner* — Ayodeji T Ojofeitimi
(74) *Attorney, Agent, or Firm* — Advantage IP Law Firm

(57) ABSTRACT

A dispenser provided by a dispenser body with an article storage chamber bounded by at least one panel with an article extraction site leading to an article storage chamber containing at least one stack of articles folded over at least once in a non-binding arrangement with each article in the stack oriented in the same direction and with the outermost article disposed proximate the extraction site and constructed to slide off the folded article stack and out through the extraction site while leaving the next article in the folded article stack exposed for subsequent withdrawal wherein the articles may be selectively withdrawn one at a time through the extraction site until the innermost article is removed from the article storage chamber along with methods of loading and dispensing such dispensers are described herein.

23 Claims, 10 Drawing Sheets

(56) References Cited

U.S. PATENT DOCUMENTS

| | | | | | |
|---|---|---|---|---|---|
| 4,487,318 | A * | 12/1984 | Roen | B65D 83/0805 | 206/494 |
| 5,170,957 | A * | 12/1992 | Carpenter | B65D 33/002 | 206/390 |
| 6,412,656 | B1 * | 7/2002 | Placik | A47K 10/421 | 221/33 |
| 6,435,350 | B1 * | 8/2002 | Huang | B26D 3/12 | 206/554 |
| 7,228,968 | B1 * | 6/2007 | Burgess | B65D 75/5838 | 206/233 |
| 2005/0279756 | A1 * | 12/2005 | Bitowft | A47K 10/426 | 221/45 |

* cited by examiner

UNIVERSAL SPACE-SAVING ARTICLE DISPENSER

CROSS REFERENCE TO RELATED APPLICATIONS

This application is a U.S. National Stage application of International Application No. PCT/US2016/038219, filed on Jun. 17, 2016, and titled Universal Space-Saving Article Dispense, which claims the benefit of Application No. 62/285,574, filed on Oct. 30, 2015, and titled Self-Collapsing Article Dispenser, and also claims the benefit of Application No. 62/230,935, filed on Jun. 19, 2015, and titled Universal, Space-saving Article Dispenser, and which are hereby incorporated by reference in their entireties.

BACKGROUND

1. Field of the Invention

The present invention generally relates to article dispensers for storing and selectively dispensing plastic bags, sheets, tissues, and other articles and, more specifically, to improved dispensers, both rigid and collapsible, aimed at replacing a variety of conventional dispensers suitable for use in retail, supermarket, industrial, commercial, residential, restaurant, and other settings while also providing space-saving features.

2. Background Art

Very little has changed in the dispensing of plastic bags, tissues, sheets, and like articles over the last 20 years other than bag manufacturing companies providing dispensing systems comprised of metal racks, hangers, and plastic bag hooks. Some examples of these systems are illustrated in U.S. Pat. Nos. 5,013,290 and 6,715,260. These systems are generally acceptable in many applications, as is commonly seen in supermarket front end applications, and require space atop counters and other working surfaces, such as a vertical wall. They are considered somewhat of a nuisance to be located atop a working surface and are generally unattractive. At times, separate metal holders and dispensers are used for multiple bag sizes, thus magnifying these issues. Without question, retailers prefer not to have bag dispensers mounted atop working counter tops, or alongside the counters on a vertical surface, and would prefer a carton dispenser hidden out of view under a counter. Likewise, for self-serve applications, for example in self-serve bakeries, it is preferred to have dispenser cartons that fit into the bag compartments located under the pastry cabinets instead of mounting them on some form of external hook or rack. In this particular instance, the appearance of the bakery area is important to retailers, and mounting external holders takes away from an otherwise attractive, clean, professional appearance.

In addition to metal racks, plastic bags are commonly dispensed in retail applications, food, and self-serve applications from traditional dispenser cartons, whereas bags are typically extracted out of a die-cut portion on the carton's top surface adjacent the front panel. It is commonly known that plastic bags dispensed from cartons as such tend to be difficult to dispense effectively and singularly, often being extracted in bag clumps. Manufacturers of plastic bags dispensed in these types of prior art dispensers will usually pack bags with bag tops facing towards the dispenser opening, in order for the user to reach in and grasp the topmost bag. To do this, bags are typically packed inside the carton in a flat disposition, allowing the bag tails to easily slide out through the dispenser opening. This is particularly important with printed retail types of bags used by customers to carry merchandise or goods.

This typical carton dispenser may also be used for ordinary plastic bags, for example, the clear, unprinted, low density variety commonly used in food applications. An example of this type of dispenser is illustrated in the Heritage Food Bag catalog. In such an application, the bags are packed in such a way as to allow the user to easily locate the outer bag wall surface of the topmost bag located proximate the small dispenser opening. In such a case, the user pinches the outer bag wall surface, extracts the bag, finds the bag mouth (either at one end or the other), opens it, and fills it with goods. This extraction and opening process may take three to five seconds to perform. This particular dispenser has the advantage of saving considerable countertop space compared to a flat dispenser carton that would require being placed on a shelf below the countertop. In such a case, the flat carton likewise needs to have sufficient space behind it to accept the larger footprint. For example, a flat stacked bag that is fifteen inches wide by twenty-one inches long requires a dispenser with at least a twenty-one inch depth. With low density bags used in the Heritage box, up to two-thirds of that space may be saved.

While the Heritage type of bag dispensing may be desirable for low density plastic utility bags, it has not been acceptable for attractive, printed retail and food service bags. Dispensing in such a manner and withdrawing them through the small dispenser opening of the Heritage style dispenser adds substantial creases and wrinkles to the bags, distorting a printed image, and is far more prevalent in bags made of the high density variety, the preferred plastic used in many retail and food applications. This type of dispensing further slows down the use of retail and food service bags since they are not grasped at the bag mouth.

Many improvements have been made to the dispensing of bags over the years, including U.S. Pat. No. 5,509,570 (the '570 patent), which quantifies the waste that may be associated with plastic bag dispensing and Dual-Tab® bags that can significantly improve dispensing as they tend to avoid multiple-dispensing, and the bags also open up when dispensed. This is further illustrated in U.S. Pat. No. 4,759,639 (the '639 patent) and U.S. Pat. No. 5,497,884 (the '884 patent). While these bag styles improve dispensing and productivity and reduce waste, they cost more to manufacture and package into their dispenser cartons with the larger footprint of bags being packed in a generally flat disposition. These types of dispenser cartons can also represent a cost factor that is as high as ten percent of the cost of the bags inside the dispenser.

In addition to the foregoing, other problems come into play when designing a bag stack and dispenser. For example, cleanliness and sanitation in such an application, along with all applications where bags and articles come into direct contact with food, is essential. For example, it is commonly understood that as much as 10% of bakery bags and articles like bakery sheets are thrown away by retailers due to ineffective dispensing that creates unsanitary conditions. Regardless of the type of prior art dispenser, cleanliness, sanitation, and waste becomes an issue due to multiple dispensing of bags stuck together and the presence of carton dust. This may be more of a concern when using the bags with food products or other sensitive goods. Likewise, an open container with a large dispenser opening may be exposed to other sanitation issues from customers and users and thus there are tradeoffs concerning both opening location and size.

An additional problem is that manufacturers of plastic bags dispensed in prior art dispensers will usually pack bags with bag tops facing towards the dispenser opening, in order for the user to reach in and grasp the topmost bag. To do this, bags are typically packed inside the carton in a flat disposition, allowing the bag tails to easily slide out through the dispenser opening. The flat disposition requires a container of sufficient length or width to accommodate the unfolded stack of bags taking up more space on the counter or presentation surface as well as a pallet used for shipping and transportation.

Bags packed in traditional dispenser cartons would ideally allow the user to locate the outer bag wall surface of the topmost bag located proximate a dispenser opening. In such a case, the user extracts the bag, and fills it with goods. This operation may take three to five seconds to do. In addition, bottom gusseted bags take up twice the space of flat bags, thus leaving the upper/forward half of the carton half-empty. This usually forces traditional bag manufacturers to load bags in a carton with one-half facing one direction and one-half facing the other, thus obviating the efficiencies of dispensing bags one at a time by grasping the bag handle at the dispenser opening. However, if the bags are alternatively packed mouth-forward and tail-forward, or folded over in a carton in a conventional configuration, it may take as long as five to eight seconds. The reduction of time for loading and dispensing articles from a dispenser is highly sought after given the benefits.

In addition to the prior art previously mentioned, significant improvement to rapid dispensing of plastic bags and articles is described in detail in our co-pending patent application International Publication No. WO 2015/031191 (the '191 publication). While the bags disclosed in the '191 publication more or less overcome all of the deficiencies of prior art, not all bag making companies are adept at making bags that can self-open. In addition, the bags described in the '191 publication are generally flat stacked as shown in FIG. 2A of the '191 publication. Like other flat stack loaded dispenser discussed above, this arrangement requires a dispenser with an elongated section to accommodate the flat stack.

In some instances, the bag stacks have been folded to reduce the dispenser size in at least one direction. Examples of these may be found in FIGS. 6 and 13 of the '570 patent. However, in both of these examples, the tail or end sections are folded up onto the main body of the bags. Should the tails be folded too far, they will overlap the handle sections making it difficult to retrieve the top most bag. In addition, for bags with bottom gussets, the folding of the tail section where the gussets are located onto the remainder of the bag stack would result in an enlarged height folded tail section adjacent a much small height section creating a significant discrepancy in the profile of the bag stack. This presents one of two problems. Either the dispenser would have to be sized to accommodate the thicker end of the folded stack leaving a significant amount of undesirable unused space around the unfolded end of the stack creating collapsing or crushing issues when the dispensers are palletized or the dispenser shaped would have to be a non-conventional shape creating additional manufacturing expenses and stacking issues when palletizing. Thus, the folding configuration shown in the '570 patent is not an ideal space-saving configuration.

Other approaches to arranging the contents of a dispenser involve the use of a rolled up bag or tissues to reduce the carton size in one direction. The bags or tissues are typically joined by a separable perforation section. However, the rolled up profile typically takes up a significant amount of space, often binds due to the heavy weight of the roll, and may not provide the preferred dispenser profile.

In addition to dispensing bags, a dispenser for dispensing plastic sheets of all sorts would be advantageous to dispense in an efficient process. The common prior art technology of the use of interleaved sheets commonly seen with pick-up tissues used in the bakery trade is an example. The manufacturing of such an article is accomplished on a machine that is generally very costly and dispenses sheet articles from a slot in the middle of the top of a box. As can be imagined, this type of dispensing is impractical in shelves, unless there is substantial headroom. Likewise, it goes without saying that any sheet packaged in a carton is in contact with paper dust, which in turn can present contamination problems. Regardless of the industry—bakery, food, deli, butchers, salon, and so on—efficient dispensing is limited to the use of chipboard and various paper board dispensers.

Another approach at dispensing tissues or sheets may be found in a conventional tissue box. Here, the cardboard carton dispenser typically includes an opening through which a set of folded tissues may be withdrawn. However, the tissues are typically interleaved or interfolded, a process that requires the use of costly machinery to perform and that would be advantageous to avoid in certain circumstances.

In addition to the lack of space saving features the prior art dispensers discussed above, in some instances a more collapsible container would be beneficial. One attempt at using a collapsible container to dispense self-opening T-shirt bags is marked on the package, Easy Pic "Thank You" T/S, which is a T-shirt bag with a tab, much like that used in grocery stores, but with an aggressive glue spot just below the tab to interconnect the outer surfaces instead of film interconnections made on the bags' treated outer layers, as is commonly done in the trade. The bag packs are generally in units of one hundred bags, folded in half, with handle ends facing rearward, and the tab (rather large in size) also facing rearward and located in the middle rear location of the outer dispenser. With three to four bag packs inside the dispenser, the tabs are sealed by heat to the outer bag pack, securing it in place. The dispenser opening is located adjacent the front middle side of the bag. When dispensing a bag, a rather aggressive dispensing motion is required to extract the bag, as the bag must be released from the tab, and then pull the next bag in sequence open. This combination of tab heat sealed to the outer container requires a manufacturing process that carefully loads the bags in the dispenser in a folded disposition, sealing the dispenser closed, then sealing the large tabs to the outer surface. Unfortunately this application wastes plastic material (the large tab) and is unsuitable for the dispensing of most bags that have no tabs. Being difficult to extract, the package slides very easily and requires two hands to dispense. Likewise, it is an unnatural dispensing compared to that of a plastic tissue or bag dispensed from a dispenser such as described in the '639 and '884 patents.

A soft-walled packet containing tissues or wipes is also well known. As with the cardboard tissue containers described above, the wipes are typically interleaved or interfolded and inserted into a soft plastic container requiring the more expensive machinery. Alternatively, the tissues may simply lay flat atop one another preventing the indexing of subsequent wipes when one is withdrawn. The package openings are often surrounded by a plastic frame to reinforce the opening as well adding more expense to the dispenser packaging.

Thus, while the dispenser and flat stack solutions provided in both '570 patent and the '191 publication overcome many of the deficiencies in the prior art, the elongated flat stack of articles presents an enlarged dispenser profile that is not suitable for all settings, especially those with limited space. To provide the same or similar number of bags in a smaller space is a significant challenge that the present invention has overcome.

What is missing from the prior art is a dispenser constructed to provide one or more of the following features: 1) storing a variety of articles such as bags, tissues, or sheets using space saving features; 2) efficaciously dispensing the stored articles one at a time; 3) providing simple, intuitive extraction of an outermost article; 4) preventing or inhibiting wrinkling and distortion of the article during withdrawal from the dispenser; 5) manufacturing cost-effectiveness including lowering costs compared to traditional dispensers; 6) maximizing bag count versus internal dispenser space; 7) providing for easy article loading in a manufacturing facility; 8) providing a dispenser that is natural to use; and/or 9) promoting cleanliness and sanitation by providing a sanitary shipping container. Any one of these features would be a significant advance in the art and valuable to the trades.

SUMMARY

In accordance with the principles of the present invention, a dispenser for storing and dispensing articles one at a time is provided with a dispenser body having an article storage chamber bounded by at least one panel and an extraction site leading to the article storage chamber containing at least one stack of articles folded over at least once in a non-binding arrangement with a first section tucked under a second section to define a folded article stack with an outermost article and an innermost article with each article in the folded article stack having a retrieval end with substantially the same orientation, the folded article stack being disposed within the article storage chamber with the retrieval end of the outermost article of the folded article stack disposed within or proximate the extraction site, the outermost article being constructed to slide off the folded article stack without binding on an adjacent article and out through the extraction site when pulled by the corresponding retrieval end while leaving the retrieval end of an adjacent article in the folded article stack exposed through the extraction site for subsequent withdrawal of the adjacent next article from the folded article stack wherein each article of the folded article stack may be selectively withdrawn one at a time through the extraction site until the innermost article is removed from the article storage chamber.

In one embodiment, the folded article stacks are oriented in the same direction and folded in a tri-fold, non-binding arrangement with the tail section of the entire stack tucked underneath the main body section.

In yet another embodiment, the folded article stacks are oriented in the same direction and folded in a bi-fold, non-binding arrangement with the tail section of the entire stack tucked underneath the main body section.

In yet another embodiment, the tail section of the folded article stacks generally point to the rear panel of the dispenser.

In another embodiment, the tail section of the folded article stacks generally point toward the front panel of the dispenser while the head section points toward the rear panel of the dispenser.

In another embodiment, the head and tail sections of the folded article stacks generally point in the same direction.

In one embodiment, the dispenser is in the form of a rigid walled carton.

In another embodiment, the dispenser is in the form of a soft-walled container.

In yet another embodiment, the articles in the article stacks are self-opening bags, other than self-opening bags, regular sheets, pop up sheets, bottom gusseted bags, side gusseted bags, flat sheets, or folded flat sheets and may have a single ply or multiple plies.

In yet another embodiment of the present invention, the dispenser includes a self-closing loading gusset through which folded article stacks may be inserted into the article storage chamber and the dispenser closed upon release.

Another aspect of the present invention is the provision of a non-slip or adhesive surface to either suspend the dispenser from an angled or overhead surface, or resist movement along a support surface to maintain the dispenser in one place during dispensing procedures. This feature may operate as an alternative to or in lieu of using mounting hardware or locating the dispenser in a fixed container to secure the dispenser in a fixed location.

Methods for loading and dispensing using the dispensers constructed in accordance with the principle of the present invention are also disclosed herein.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

DETAILED DESCRIPTION

A. Description of an Exemplary Dispenser

Referring now FIGS. 1A-1F, a first exemplary embodiment of a dispenser, generally designated 10, is shown with a dispenser body 12 or carton having a plurality of panels 14, 16, 18, 19 (FIG. 1D), 20, and 22 (FIG. 1D) cooperating to define an article storage chamber 24 (FIG. 1D) for storing a plurality of articles, generally designated 26*a*, 26*b* (FIGS. 1F-1G), sequentially arranged in one or more folded article stacks, generally designated 28*a-d* (FIGS. 1B-1D), the individual articles being selectively dispensable one at a time through an extraction site (opening) 30 in the dispenser body. In this and other exemplary embodiments described herein, the construction of a single folded article stack and related loading and extraction processes will be described in more detail below.

Figure 1A:
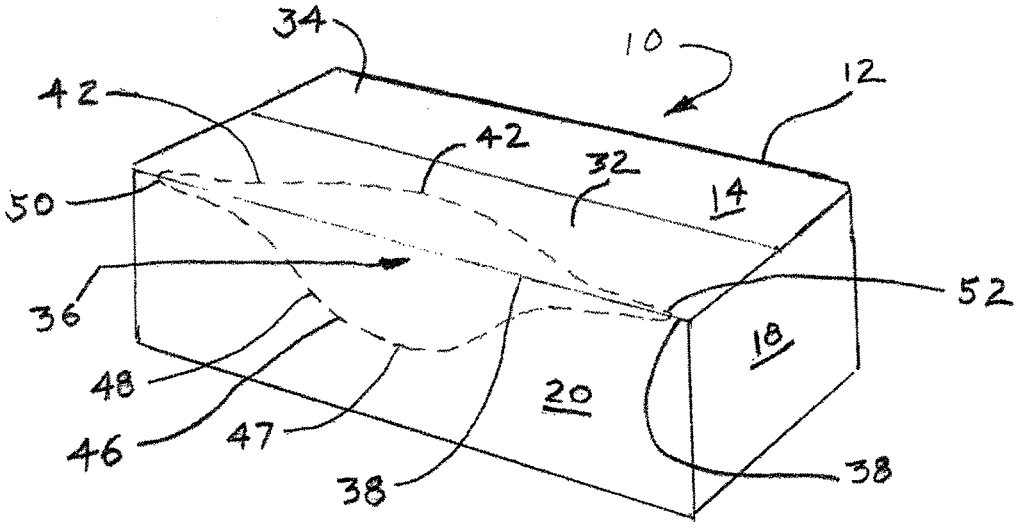
FIG. 1A is an upper right perspective view of an unopened exemplary dispenser constructed in accordance with the principles of the present invention.

Referring now to FIG. 1A, the dispenser body 12 of this first exemplary embodiment generally includes a plurality of planar or substantially planar panels including a top panel 14 and an opposing bottom panel 16 (FIG. 1D), a right side panel 18 and identical opposing left side panel 19 (FIG. 1D), and a front panel 20 and an opposing rear panel 22. All of the opposing panel sets are parallel or substantially parallel to each other in this exemplary embodiment resulting in a hexahedron dispenser configuration, although the edges may be angled or rounded. However, this is not meant to be limiting and other dispenser shapes may be used. While in this exemplary embodiment, the panels are preferably constructed of a relatively thin cardboard material, other suitable materials such as thick cardboard or chipboard, rigid plastic, metal, or wood are also contemplated.

Figure 1B:
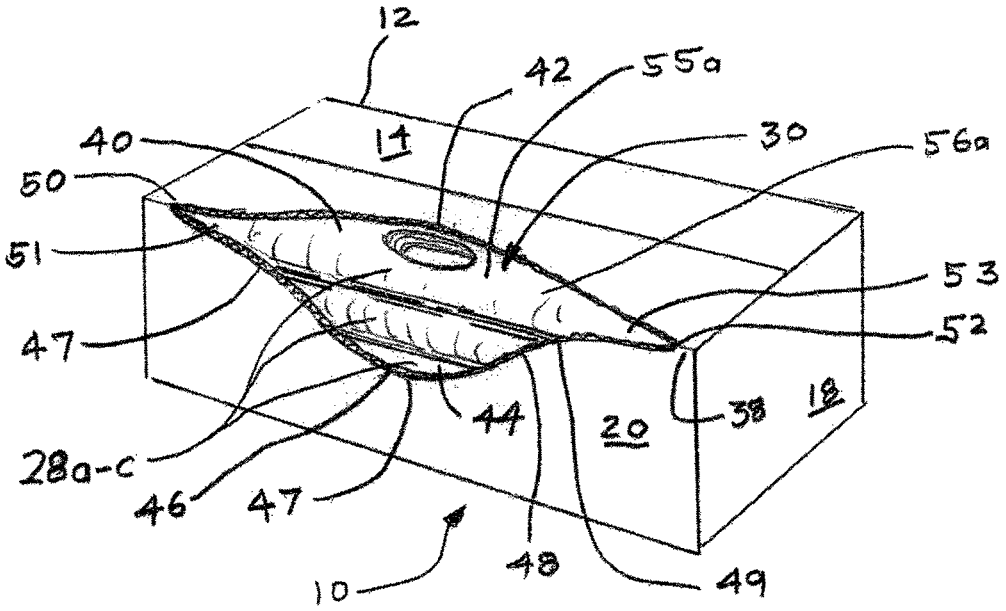
FIG. 1B is a similar view to that FIG. 1A in an open, ready to dispense configuration.
Figure 1C:
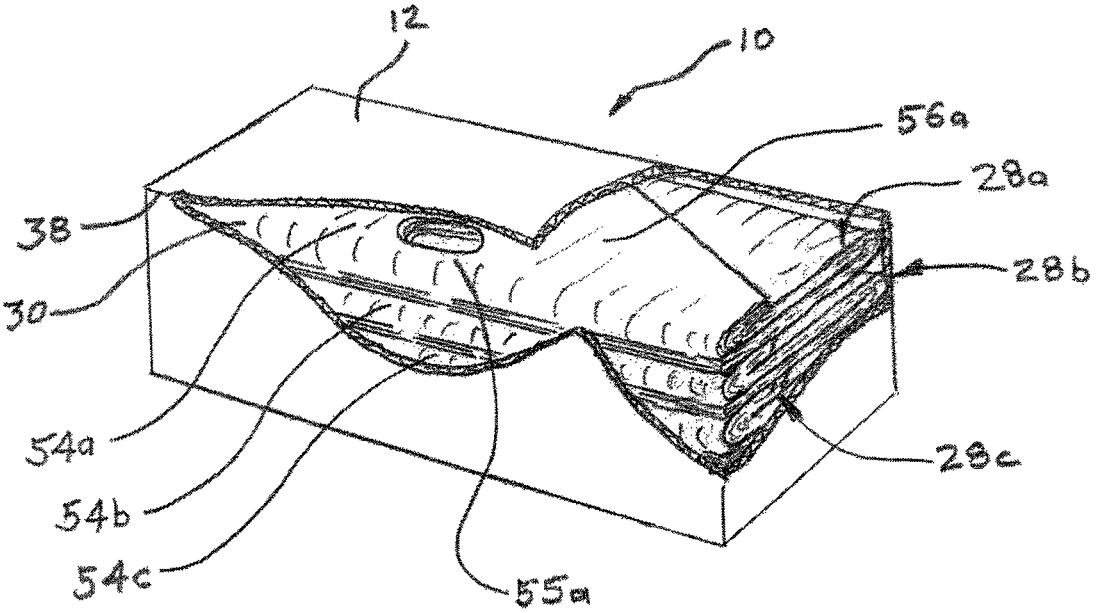
FIG. 1C is a similar view to that FIG. 1B with a partial cutaway of the dispenser with articles (bags) stacked inside illustrating the non-binding soft folds in an accordion-like stack.
Figure 1D:
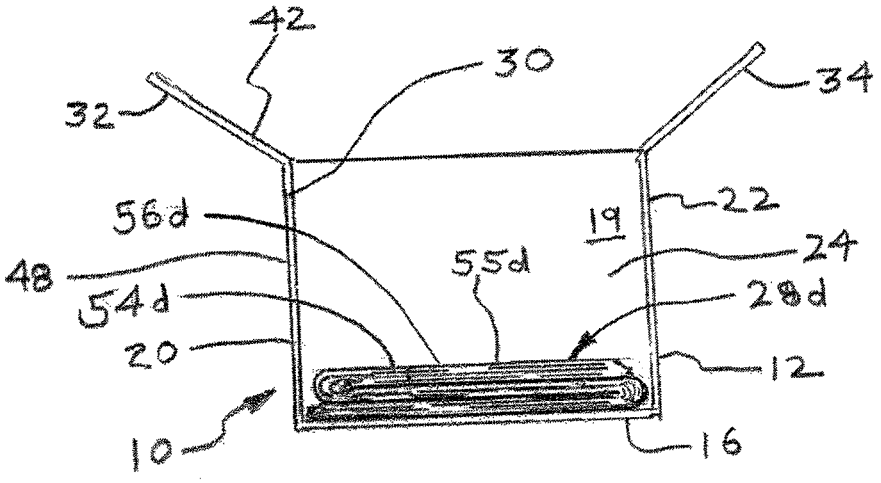
FIG. 1D is a cutaway side view of the carton with bag articles stacked inside illustrating the S-shaped accordion-like stack.

With continued reference to FIGS. 1A and 1D, the top panel includes a front section 32 and a rear section 34 that may be joined together along a seam 36. While the folded article stacks 28*a-d* may be loaded through the opening 30 in the dispenser body, these complementary sections 32 and 34 allow for an alternative insertion region of one or more folded article stacks 28*a-d* into the article storage chamber 24 of the dispenser body 12. After the folded article stacks are loaded into the article storage chamber, the front and rear sections may be sealed together using conventional means to provide a permanent or more temporary seal, such as when re-using the dispenser for reloading folded article stacks after the dispenser is emptied.

With continued reference to FIGS. 1A-1G, in this exemplary embodiment 10, the opening 30 provides an extraction site for selectively retrieving one or more articles 26*a*, 26*b* from the folded article stacks 28*a-d* within the article storage chamber 24. In this exemplary embodiment, the opening projects through a portion of the front section 32 of the top panel 14 and a portion of the adjacent front panel 20. To form the opening 30, the corresponding panels of the dispenser body 12 are perforated to provide a cut-out region 36 acting as a cover that may be removed to form the opening 30 or mouth into the article storage chamber 24. In this first exemplary embodiment, the opening 30 left behind after the complementary cut-out region 36 is removed is generally separated by a right angle corner 38 or fold line where the top panel 14 meets the front panel 20. Projecting back toward the rear panel 22 within the top panel 14 is an upper opening 40. The upper opening generally forms a substantially concave perimeter 42, relative to the fold line 38. The other portion of the opening 30 projects downwardly toward the bottom panel 16 within the front panel 20 providing a forward facing opening 44. The central section of the forward facing opening is also substantially concave relative to the fold line 38 forming a valley 46 with a low point 47 about midway down the front panel 20 and half way between the left panel 19 and the right side panel 18 with the left and right outermost ends of the forward facing opening turn outwardly at left and right elevated sections 47, 49, respectively, such that the perimeter 48 of the forward facing opening is a complex curve similar to a bow shape. Together, the upper perimeter 42 (or perforated line) and front facing perimeter 48 cooperate to define the opening 30 or mouth leading to the article storage chamber 24. The upper perimeter and front facing perimeter meet at the fold line 38 in this exemplary embodiment. In general, the upper perimeter 42 has a larger radius of curvature across the concave region compared to the smaller radius of curvature across the concave region of the front facing or lower perimeter 48. As the perimeters approach one another, the overall size of the opening 30 converges on each lateral side to a left side narrow gap 51 terminating at the extreme left end 50 of the opening near the edge of the left side panel 19 and a right side narrow gap 53 terminating at the extreme right end 52 of the opening near the edge of the right side panel 18.

Figure 1E:
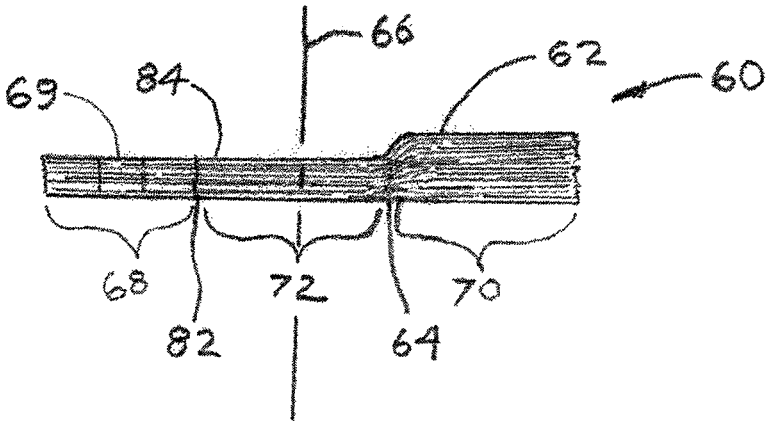
FIG. 1E is a side view of an exemplary unfolded (flat) article stack for folding and loading into the dispenser of FIG. 1D.
Figure 1F:
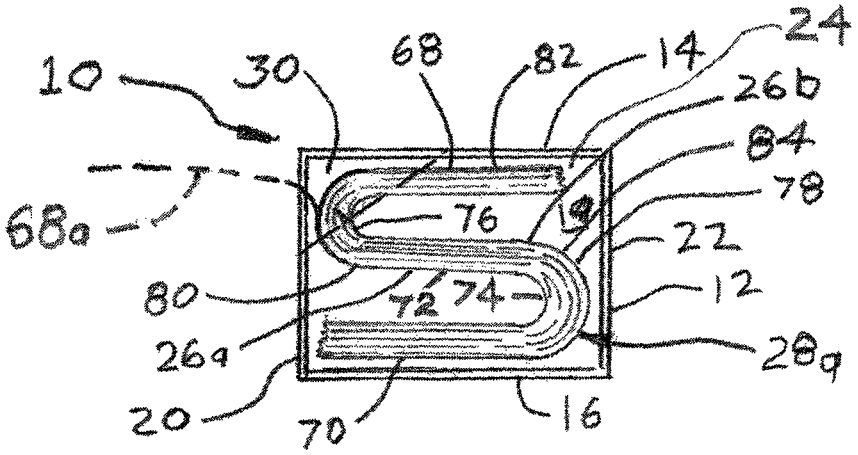
FIG. 1F is a simplified schematic view of a tri-folded (S-shape) article stack with the right side panel of the dispenser removed.
Figure 1G:
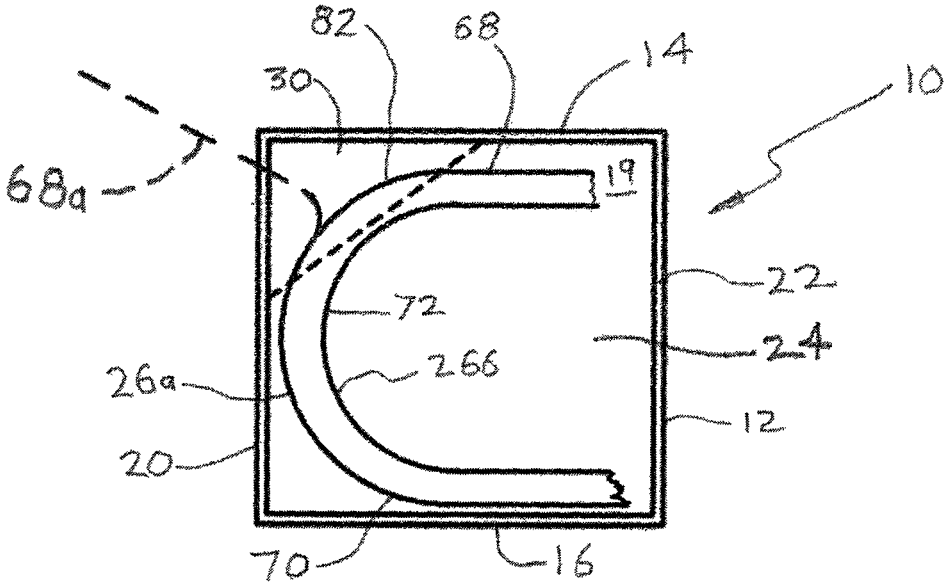
FIG. 1G is a simplified schematic view of an alternative folded article stack (bi-folded C-shape) with the right side panel of the dispenser removed.

The cut-out lines or perforations 42 and 48 are typically formed in the top panel 14 and adjoining front panel 20, which when the perforation's tit connections are broken, the entire cut-out 36 may be removed, thus defining an dispenser opening 30 leading into the article storage chamber 24 as illustrated in FIGS. 1B and 1F-1G. These perforated lines are typically fabricated when the dispenser carton 12 is manufactured and is then subsequently extracted by a user to prepare the carton contents (folded article stacks 28*a-d*) for dispensing. It is important to note that unlike prior art, the dispenser cut-out of the present invention may be made on the most inexpensive of all carton types, the common regular slotted carton (RSC) carton, as opposed to other types of carton manufacturing process that require more cardboard material due to thickness requirements, or more material due to greater width or draw requirements, are less efficiently manufactured, and are overall more costly. While the dispensing cut-out 36 in FIG. 1A and the dispenser opening 30 in FIG. 1B may be the preferred embodiment for the carton 12 of the present invention as illustrated herein, it is not necessary to have rounded cut-out corners and lines. Straight, rectangular lines or a combination of straight and rounded lines may suffice in many applications. However, for ease of extracting bags as will be subsequently illustrated in this exemplary embodiment of the present invention, rounded and enlarged perimeter lines tend to encourage bags to extract more easily, reduce wrinkling and distortion of the articles as they are withdrawn from the article storage chamber 24 through the opening 30. In addition, providing more opening in the front panel and less in the top panel reduces the likelihood of contaminant entering into the article storage chamber.

Referring now to FIGS. 1B-1C and 1F-1G, the cut-out region 36 of dispenser body 12 of FIG. 1A has been completely removed in FIG. 1B allowing the underlying stacks of bags 28*a-d* and their respective bag tops 54*a-d* (FIGS. 1B, 1D) to be located at or near the opening 30, ready for a user to grasp and dispense. It is a primary objective of the present invention to have all bag handles, or bag tops (or bottoms as the case may sometimes be), disposed in a position proximate the opening 30 that allows clear access by a user to the handles and tops (or bottoms if reversed) and intuitively know how to dispense the internal bags or articles. As illustrated, the topmost handle 55*a* (FIG. 1C) of topmost bag 56*a* of the topmost bag stack 28*a* may be easily grasped and dispensed as subsequently illustrated herein.

B. Description of Exemplary Folded Article Stacks

Referring now to FIGS. 1B-1C, several folded article stacks, generally designated 28*a-d*, are stacked one atop the other, with their aligned handle portions on the top, upper fold in the stack, in which a top handle portion 55*a* of the topmost bag 56*a*, lies near or below dispenser opening 30 and is easily accessed by a user's hand. As described below in a subsequent embodiment, it is preferred in some circumstances to use a collapsible top and/or side panels to maintain the opening even closer or atop the topmost bag of the bag stack as more and more bags are withdrawn.

Referring now to FIG. 1E, an exemplary article stack, generally designated 60, is depicted in an unfolded (flat) stack configuration, also referred to as a pre-loading or pre-folded configuration. In the flat stack configuration, the stack includes an uppermost face 62 and an opposing lowermost face 64, a centerline 66, a head section 68 with handle openings 69 corresponding to the retrieval or handle section of the articles, a tail section 70 corresponding to the bottom end of the articles, which may or may not include a gusset, and a main body or central section 72 spanning between the handle section and the tail section. Some bags may include a side gusset projecting along the sides of each section as well. In addition, the flat stack is arranged such that the head section of each adjacent article is disposed adjacent the head section of an adjacent article and likewise for the tail section. In other words, each article is arranged in the same end to end orientation as an adjacent article and thus the entire stack of articles faces the same way. The articles are stacked sequentially as well. When arranged in the folded configuration as described below, the top most or outermost article (in this exemplary embodiment, the bag 56*a* (FIGS. 1B and 1C) closest to the opening 30) is removed from the folded article stack prior to the next outermost article and so on until the innermost article (closest to the rear panel) is removed from the article storage chamber 24 and no articles remain in the dispenser. In the flat stack configuration, there is a lowermost bag 82 and an uppermost bag 84.

Referring now to FIGS. 1D-1E, the flat stack 60 of FIG. 1E is preferably folded at least once either before placement in the article storage chamber 24 or as the flat stack is being placed into the article storage chamber. In this exemplary embodiment, one or more flat stacks 60 are tri-folded (S-shape) and loaded into the article storage chamber 24 of the dispenser body 12 in an S-shaped accordion-like manner with non-binding soft folds. In this exemplary embodiment, the articles are bags and thus the flat stacks may also be referred to as bag stacks, whether in a folded or flat configuration. More specifically, in this exemplary embodiment, the folded article stacks 28*a-d* are folded such that the bag tail section 70 of the flat stack 60 is tucked under the main bag body 72 of the bag stack. In addition, the head end section 68 of the bag stack is folded onto the main body 72 of the stack in this instance. In this instance, the head end sections 68 of the bags are pointing generally toward the rear panel 22 of the dispenser body 12 while the tail sections 70 of the bags are pointing generally toward the front panel 20 of the dispenser in an opposing direction. With the folding of the flat stack 60, a first soft non-binding fold line 74 is introduced between the tail section 70 and the main body section 72. Similarly, a second soft non-binding fold line 76 has been introduced between the head section 68 and the main body section. The second fold line is disposed higher within the article storage chamber 24 than the first fold line. These soft fold lines contribute to allowing for an easy withdrawal of the outermost bag from the bag stack. While it is generally preferable to place the folded article stacks 28*a-d* into the article storage chamber with the handle sections uppermost, other scenarios may demand the tail sections placed uppermost.

Moreover, when the flat stack 60 is folded into the tri-fold configuration and placed into the article storage chamber 24, the uppermost surface 62 of the flat stack is re-oriented such that the uppermost surface of the flat stack becomes the innermost surface 78 (FIG. 1F) of the tri-folded stack 28*a*. Similarly, the lowermost surface 64 of the flat stack is re-orientated to become the outermost surface 80 (FIG. 1F) of the tri-folded stack 28*a*. In operation, as discussed further below, this re-orientation allows the bottom bag 82 of the flat stack 60 to be withdrawn first when folded into the tri-fold configuration and the uppermost bag 84 of the flat stack to be withdrawn last in sequence.

It will be appreciated that this S-shaped article stack 28*a-d* configuration (FIGS. 1B-1D and 1F) overcomes a significant drawback of the prior art which includes a fold in the tail section that is folded back onto the upper facing portion of the bag stack since that arrangement works against using a smaller profile dispenser. While that tailed folded on top of the main body configuration may be more useful for side gusseted or flat articles, the problem of providing a reduced profile dispenser is compounded when using bottom gusseted articles and folding the tail sections on top of the main body of the bag stack. The first issue is that folding the tail section onto the upper facing surface of the flat bag stack may cover the handle section in order to reduce the dispenser profile. Since the tail section covers the handle section, the withdrawal of the bags from the bag stack is rendered difficult and time consuming. For example, instead of withdrawing the bag by a handle to either automatically open or at least withdrawn by the handle as in a natural usage, the bag would be withdrawn by the bottom end and be upside down when removed. This would require the user to then turn the bag right side up before opening and/or loading adding unnecessary and undesirable time to the dispensing and loading event due the extra step and may lead to confusing the user.

In addition, in the case where the article stack 28*a-d* consists of bottom gusseted bags, the thickness at the tail end 70 of the flat stack 60 is considerably greater than the thickness of the bag stack at the handle end 68. Thus, the dispenser requires a larger space at one end to accommodate such bag stacks. For example, in a two ply bag, the gusset area totals four plies in height when viewed from the side. Then, when a single bottom gusseted section 70 is folded onto the main body of the bag, the folded section has six plies, two from the main body and four from the gusseted section, while the unfolded section only has two plies. This height difference is amplified as the number of bags in the stack increases. As the number of bags stacks up, this creates a significant discrepancy between the cross-sectional height of the folded end and the cross-sectional height of the unfolded end. This height discrepancy requires either a non-standard dispenser shape creating palletizing and stacking issues or a large void in one end of the dispenser which wastes space and which likely results in crushed dispensers when multiple dispensers are stacked atop one another as in a palletized setting. This would require more cost prohibitive dispenser constructions with thicker walls to resist crushing.

Instead, the S-shaped article stack 28*a-d* configuration as depicted in FIGS. 1B-1D overcomes the issues of the prior art stacking arrangements by folding the tail section 70 underneath the main body section 72 and the head or handle section 68 over the main body section. In addition, the tail section 70 generally points toward the front panel 20 of the dispenser body 12 while the head section 68 points toward the rear panel 22 of the dispenser body 12. The head section is also disposed adjacent the opening 30. This arrangement maintains the handle section of each new outermost bag proximate the opening as each new bag is removed while the innermost bag is retained until the last withdrawal. There is no expensive interfolding or interleaving of adjacent bags in opposing directions as all bags in the present invention are folded in the same direction. Thus, the topmost or outermost bag 82 may be extracted by sliding the handle section 68 back toward the opening 30 and further sliding the outermost bag off the article stack with minimal resistance as further described in FIGS. 2A and 2B leaving the adjacent bag in place as the new outermost bag. Each subsequent bag may be selectively and sequentially withdrawn from the article stack. Withdrawal may continue as long as there bags remaining in the article stack. As described above, loading bags in this tri-fold manner as illustrated is particularly useful with bottom gusseted bags as essentially all of the internal carton space is filled with bags, and thus maximizing bag count in a reduced profile dispenser that uses less cardboard stock, and can be made in a more efficient carton manufacturing process, thereby lowering overall carton costs.

As the gussets for bottom gusseted bags are typically about one-third the height of the bag, the S-shaped, tri-fold configuration minimizes the profile of the bag stack allowing for a smaller dispenser to be used. Where the gusset lengths are different or no gussets are provided, additional folds may be used when loading the bag stacks and the bags stacks may have more than two folds. It will also be appreciated that the flat stacks 60 may be folded as they are loaded into the article storage chamber 24 or may be pre-folded into a folded article stack 28*a-d* and then loaded into the article storage chamber.

It is preferred to have the article stacks 28*a-d* take up all or substantially all of the internal space of the dispenser carton 12 defined by the article storage chamber 24 when initially loaded to provide a full or practically full dispenser. This inhibits palletized stacks from collapsing and is preferred industry practice to pack as many articles in the interior as possible. Thus, folding the articles into a configuration where one end takes up more space than an opposing end or other section as in the prior art configurations that provide folded tail section back onto the main body of the article stacks are inefficient and not preferred and something the present invention overcomes.

Figure 2A:
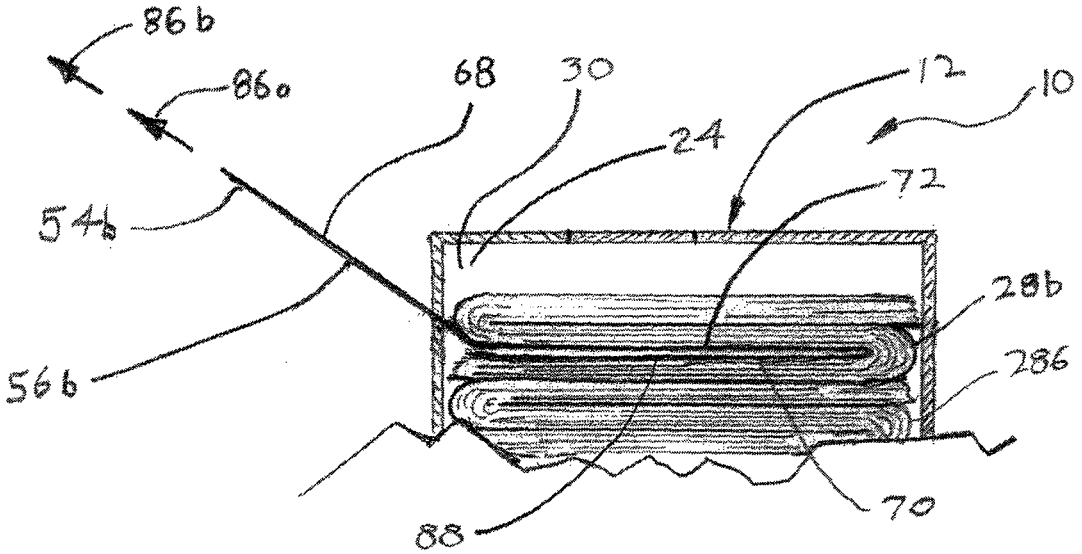
FIG. 2A is a side cutaway view of the dispenser of FIGS. 1A-1B with the uppermost stack and cut-out removed and a non-self-opening, topmost bag being partially extracted from the dispenser in a non-binding manner.

Turning now to FIGS. 1B-1D, in this exemplary embodiment, the articles in the folded article stacks 28*a-d* (folded bag packs) are of the wave-top variety and are typically in units of twenty-five to one hundred bags, perhaps as many as two hundred. The number of bags in a pack depends on several factors including manufacturing efficiencies, size and weight of a bag pack, length, width and style of bag and the type of film. What is most important with these bag packs is that they are in numbers that are reasonably lightweight, and allow all individual bags in the stack to be freely extracted in a non-binding unfolding action, thus with minimal resistance as illustrated in FIG. 2A. Preferably, the bag packs 28*a-d* used with a dispenser carton 12 of the present invention should not have excessive weight so that the weight of the pack resting atop a topmost bag body does not create excessive resistance and difficulty when extracting the body portion of the topmost bag. As one non-limiting example, in general bag packs (folded article stacks) would weigh in the range of 2.5-3.0 pounds per pack for heavier weight carry bags. This would be sufficiently lightweight to ensure efficacious dispensing of the articles to avoid binding issues. However, even bags such as extremely large bags used for pallet covers may weigh as much as one pound and a stack up to ten pounds yet remain extractable in a non-binding manner using the dispensers described herein. As bag stacks are commonly arranged in stacks of twenty-five, fifty, or one hundred articles depending on bag size and gauge, smaller stacks may be used for heavier bags, if necessary, to keep the overall weight down. Likewise, it is preferred that all bags in a bag pack be loaded with the handles located near, adjacent, or within easy reach through the dispenser opening 30, regardless of how they are loaded into the carton (tails forward or backward). With a tri-fold bag pack, it is preferred to have the tails 70 pointing forward and handles 68 pointing rearward as illustrated in FIGS. 10, 1F.

Turning now to FIG. 1F, a simple schematic of a reduced set of exemplary bags 28*a* is shown within a dispenser carton 12 with the right side panel removed and the cut-out removed as well leaving the opening 30 into the article storage chamber 24. The bags in the bag stack 28*a* are shown in a loose arrangement for ease of description. The outermost bag 82 is shown in a tri-fold configuration adjacent the innermost bag 84. The distal ends of the tail section 70 of each bag generally point toward the front panel 20 of the dispenser carton 12 while the retrieval ends or handles of the handle section 68 generally point toward the rear panel 22. A first lower fold 74 is disposed between the tail section and the main central body 72 of the bag stack. A second higher fold 76 occurs between the central body and the head section 68. The outermost surface of the handle section 68 (formerly a portion of the lowermost surface 64 of the flat stack 60 (FIG. 1E)) is positioned above the upper fold line 76 in FIG. 1F generally faces toward the top panel 14 and opening 30 while the lowermost surface of the tail section 70 (formerly a portion of the uppermost surface 62 of the flat stack 60) generally faces the bottom panel 16 with the main body section 72 sandwiched therebetween. This configuration ensures the lowermost bag 82 of the flat stack 60 will be removed first by peeling off the handle 68*a* (shown in dashed lines) and withdrawing through the extraction site 30 and the uppermost bag 84 of the flat stack 60 will be removed last in the sequence once arranged in the tri-fold configuration and placed into the article storage chamber 24 with handle section 68 uppermost proximate the opening.

Instead of a folded article stack 28*a-d* being arranged in a tri-fold disposition or S-shape as in FIG. 1F, an alternative folding configuration is presented in FIG. 1G by introducing a two-fold disposition or C-shape into the flat stack 60 (FIG. 1E) with the bag tails 70 folded under the bag handles 68 with the handles still positioned near the dispenser cut-out opening 30. Here, the distal ends of the collective tails of each article in the tail section 70 generally point toward the rear panel 22 as do the retrieval ends of the head section 68. In such a case, the user still extracts a topmost bag 82 by withdrawing the handle 68*a* (shown in dashed lines) through the extraction site 30 in more or less the same accordion-like unfolding methodology as a bag from a tri-fold bag pack. With some bags, such as with the bottom gusseted variety, folding the handles towards the bottom gusset would typically stop just short of the center crease in the bottom gusset in order to properly fill the space inside the carton. This is due to the bottom gussets being a 4-ply thickness, and by folding the bag tops (2-ply) atop the bag body (also 2-ply), the space in the carton is suitably, equally filled. Bag packs that are loaded in a two-fold disposition will preferably have its tails facing backward and bags would most likely be dispensed in a more upward disposition as opposed to the tri-fold bags that would be dispensed upward and/or forward. It will be appreciated that the bags may be folded in half with the tail sections directly beneath the handle sections, or folded with the tails extending under and past the handle sections, or folded with the tail sections extending under but less than the handle sections relative to the rear panel 22 of the dispenser carton 12. Preferred tail tucked under, non-binding, folding configurations to maximize the space within the article storage chamber 24 may be selected depending on the gusset location, if any, on the bags. For example, flat stacks or sheets and side gusseted bags may generally be stacked by folding the stacks in half while it may be preferable to tri-fold or bi-fold bottom gusseted stacks with less or more than a complete overlap wherein the head and tail sections are offset from one another.

C. Description of an Exemplary Dispensing Method

Referring now to FIG. 2A depicting the dispenser 10 and dispenser carton 12 of FIG. 1A with the uppermost bag stack 28*a* removed, the topmost bag article 56*b* of bag pack 28*b* (e.g., after bag pack 28*a* has been completed dispensed) may be dispensed from carton 12 through extraction site 30 by a user grasping the die-cut handle 54*b* located in top handle portion 68 of the bag stack 28*b* and pulling the handle 54*b* forward, somewhat upward, and thus outward (arrows 86*a*, 86*b*), thereby initiating the extraction of the uppermost and outermost bag 56*b* out of dispensing cut-out opening 30. As bag handle portion 54*b* is withdrawn off the remainder of the article stack 28*b* through the cut-out opening 30, the corresponding bag body 72 and tail portion 70 slide off the article stack 28*b* and follow the forwardly disposed C-shaped path 88 illustrated by heavy lines defining bag body 72 and bag tail portion 70, in a non-binding unfolding action. It is understandable that this type of operation is facilitated due to the non-binding manner in which the bag packs were originally loaded into the carton as described in FIGS. 1C and 1F, and the light weight of the bags in bag pack 28*b* located immediately atop bag body 72 and bag tail portion 70. Upon completion of the dispensing operation, the user is grasping the bag by its handle 54*b* (or in the topmost handle region), ready to separate the two handle plies, open the bag mouth, and load the bag with merchandise.

The topmost bag may also be dispensed by extracting it in the opposite direction through dispenser opening 30 with minimal resistance. In that scenario, the bag handle 68 of the uppermost bag 56*b* would be pulled toward the rear panel 22 of the dispenser carton 12. Likewise, a tri-folded bag stacks 28*a-d* may also be loaded in article storage chamber 24 of the dispenser carton 12 with the bag tails 70 facing backward toward the rear panel 22 of the carton 12 and the handles 68 facing the front panel 20. However, in doing so, the binding resistance typically increases (some bag types more than others depending on film type, size and gauge), thus may require bag packs to be of a shorter count and/or weigh less.

Referring back to FIG. 1B, the efficacious dispensing of bags described in FIG. 2A is facilitated by the dispenser opening 30 being sufficiently wide enough to allow the topmost bag 56*a-d*, when exposed, to be extracted so that the bag will not form creases and wrinkles along the side edges at points 50 and 52, as would be prevalent in prior art cartons such as that of the Heritage Food Bag variety with a narrower opening, or the number of common dispenser cartons that are packed with layflat bags. The dispenser opening 30 of this exemplary embodiment ideally narrows at its two side end points 50, 52, which also helps prevent accidental multiple dispensing. The lower valley portion 46 of the dispenser opening 30 is typically cut low enough to allow a user's fingers or hand to reach inside and grasp the topmost bag. When extracted, the higher elevations 47 and 49 on both sides of valley 46 help retain the other bags in the pack securely in the carton. It is also easy to see that upon extracting a topmost bag from the carton, the upward curves adjoining valley 46 forming the higher elevations 47 and 49, and terminating at the side edges 50 and 52, cause a topmost bag 56*a-d* to be channeled upward and out of the carton, through the narrow gaps 51 and 53.

Figure 2B:
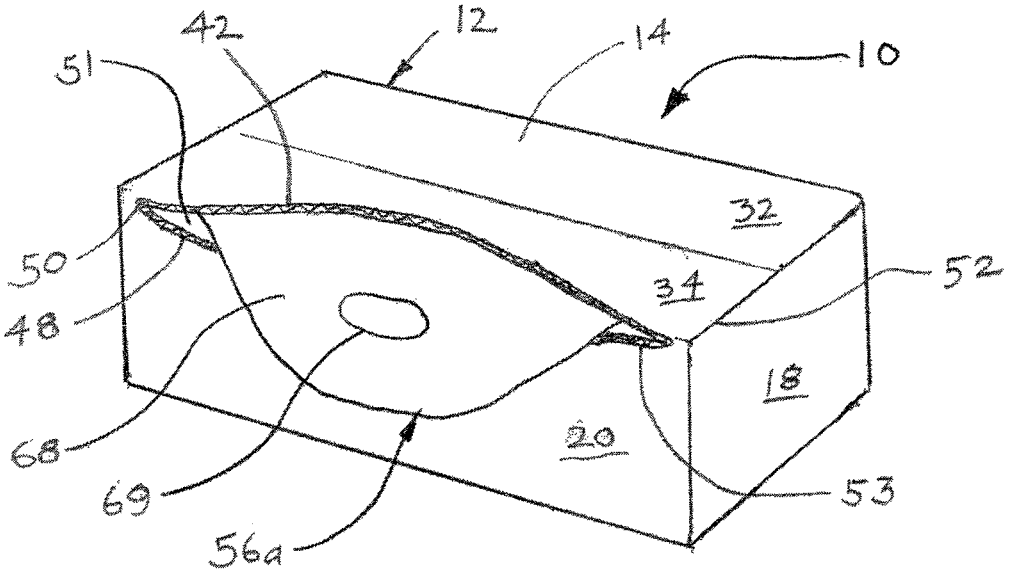
FIG. 2B is a similar view to FIG. 1B illustrating the dispenser with a topmost bag handle partially extracted through the dispenser opening as may occur when using a self-opening bag stack.

Referring now to FIG. 2B, a topmost self-opening bag article 56*a* (FIG. 2A) such as the self-opening bag variety described in our pending '191 publication has already been dispensed from carton 12 much like that of the topmost bag in FIG. 2A. During that retrieval of the topmost bag, the user grasped only the front die-cut handle located on the front handle portion and extracted the bag out of dispenser opening 30 with the bag body and tail following the same C-shaped path described in FIG. 2A with minimal resistance. However, upon extraction of this previously dispensed self-opening bag, the rear die cut handle and rear handle portion of the topmost bag was interconnected to the front handle portion 68 and the front die-cut handle 69 of the what was the next-bag-in-sequence, and thereby withdrawing front handle portion out of dispenser opening 30 as illustrated. In other words, in FIG. 2B, the outermost bag has already been withdrawn and the next bag in the sequence has been partially withdrawn with the outermost handle section 68 indexed and ready for retrieval due to a weak interconnection to the prior withdrawn bag. The weak interconnection was broken upon the completion of the extraction of the previous self-opening bag much like that as explained in our '191 publication. In such a case, the handle portion 56*a* rests outside carton 12 typically in a downward disposition along front panel 20, and available for a subsequent self-opening dispensing by a user. At times, handle portion 56*a* may also rest atop carton 12 depending on the location of the dispenser carton and whether the user is dispensing a bag by pulling upward or outward. In either dispensing operation, the front panel 20 or the top panel 14 of the carton serves as a separator in between bag plies much like that explained in the '191 publication. Upon completion of the extraction of bag 54*b*, the underlying interconnected bag then becomes the topmost bag with its front handle portion hanging outside the dispenser ready for its subsequent self-opening dispensing. It will be appreciated that such self-opening bags pop open and ready for loading upon withdrawal from the dispenser 10.

D. Description of an Exemplary Collapsible Dispenser

While the foregoing embodiments provide significant advantages over conventional cardboard or other rigid panel dispensers, in many instances, it will be advantageous to provide a soft-paneled dispenser, which may even more closely conform to the profile of the bag stacks. With that in mind and referring now FIGS. 3A-3C, an exemplary embodiment of a soft-walled dispenser, generally designated 110, including a dispenser body 112 having a plurality of panels 114, 116, 118, 119, 120, and 122 cooperating to define an article storage chamber 124 for storing a plurality of articles, generally designated 126 (FIG. 3B-3C), that are sequentially arranged in one or more folded article stacks, generally designated 128*a* (shown in dashed lines in FIG. 3B), to be dispensed one at a time through an opening 130 in the dispenser is illustrated. In this exemplary embodiment, the folded article stack 128*a* is similar or the same as those article stacks 28*a-d* discussed above. Exceptions and differences will be noted below.

Figure 3A:
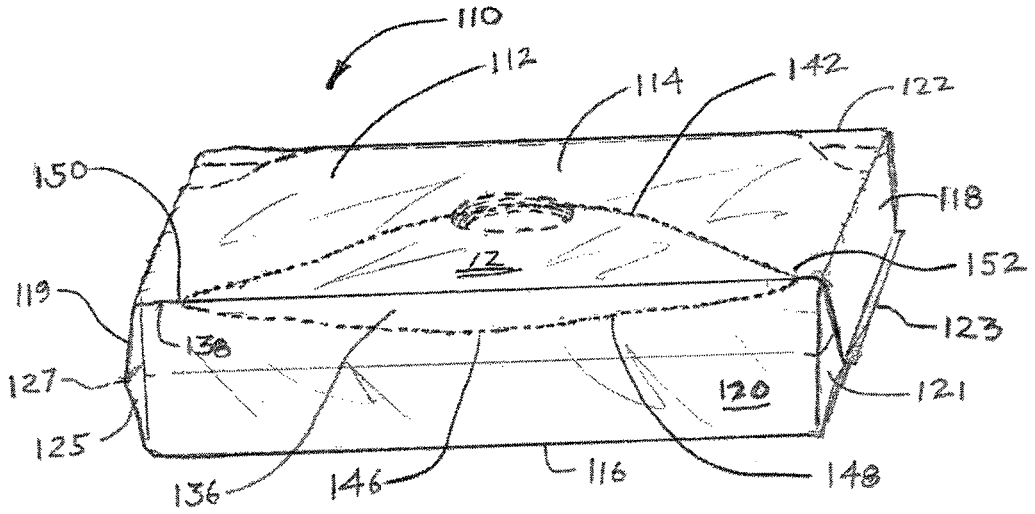
FIG. 3A is an upper right perspective view of an unopened alternative exemplary dispenser constructed in accordance with the principles of the present invention.

Referring now to FIG. 3A, the dispenser body 112 is generally in the form of a soft-walled plastic film container and consists of a plurality of flexible and collapsible panels including a top panel 114 and an opposing bottom panel 116 (front edge shown), a right side gusseted panel 118 and identical opposing left side gusseted panel 119, and a front panel 120 and an opposing rear panel 122 (upper edge shown). All of the opposing panel sets are generally parallel or substantially parallel to each other in this exemplary embodiment forming a rough hexahedron shape. However, this is not meant to be limiting and other dispenser shapes may be used.

Figure 3B:
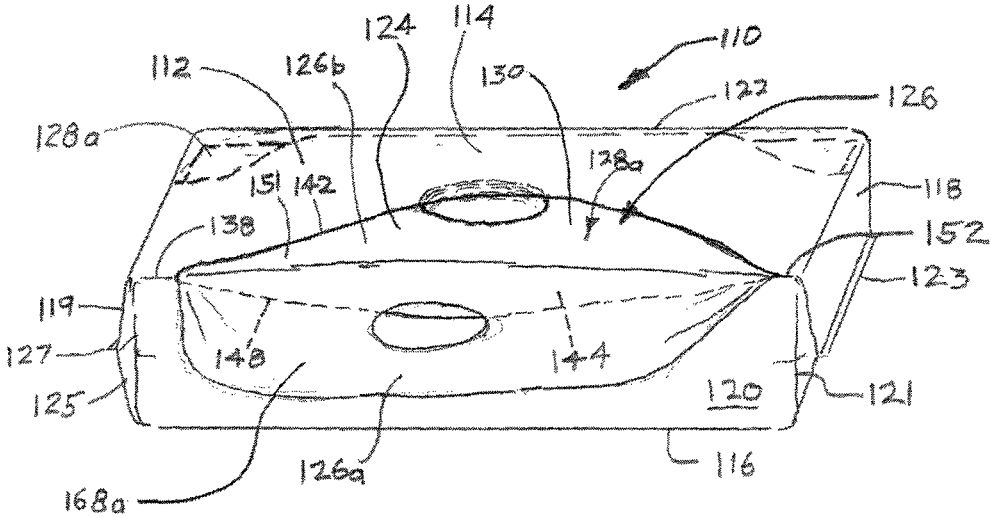
FIG. 3B is a similar view to that of FIG. 3A in an open, ready to dispense configuration and with a bag being partially dispensed.
Figure 3C:
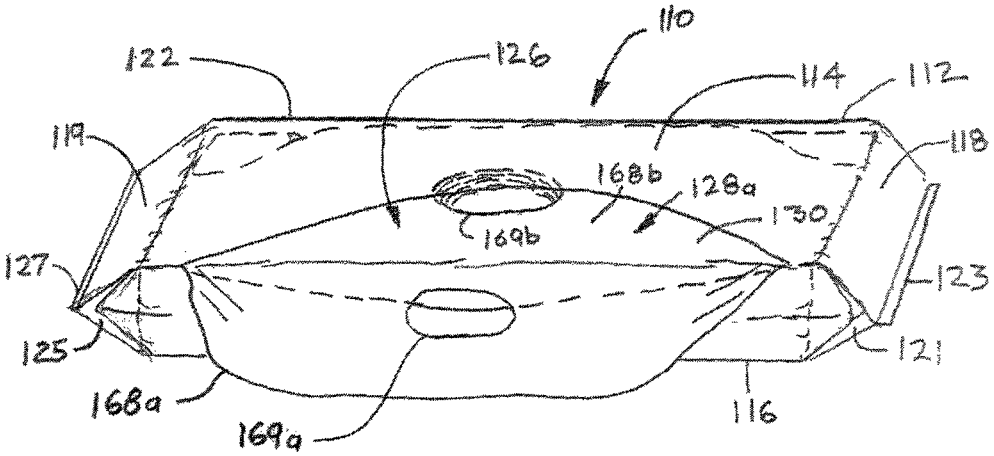
FIG. 3C is a similar view to that of FIG. 3A after one-half of the bags have been dispensed and illustrating the dispenser's self-collapsing properties.

With continued reference to FIGS. 3A and 3C, the right side 118 includes a gusset 121 with two opposing sections that may be joined together along a seam 123. Similarly, the left side panel 119 includes a gusset 125 with two opposing sections that may be joined together along a seam 127. These gussets 121, 125, generally lay flat when the dispenser body 112 is filled and expand outwardly as the articles 126 are removed from the article storage chamber 124. These gusseted sections 118, 119 also allow for insertion of one or more folded article stacks 128*a* into the article storage chamber 124 of the dispenser body 112. The left and right seams may be sealed together and separated using conventional means. One seam may be sealed prior to insertion of one or more article stacks to provide a closed end to provide a stop when inserting an article stack to align the article stack within the article storage chamber. The opposing gusset may then be sealed after insertion of the article stack.

In this exemplary soft-walled embodiment 110 as illustrated in FIGS. 3A-3C, the opening 130 provides an extraction site for selectively retrieving one or more articles 126 from the folded article stacks 128*a* within the article storage chamber 124. In this exemplary embodiment, the extraction site 130 appears in both the forward region of the top panel 114 and the adjacent upper region of the front panel 120. To form the opening 130, the dispenser body 112 is provided with a perforated cut-out region 136 acting as a cover that may be removed to form the opening 130 or mouth into the article storage chamber 124. In this exemplary embodiment, the opening 130 left behind after the complementary cut-out region 136 (FIG. 3A) is removed is generally separated by a right angle corner 138 or fold line where the top panel 114 meets the front panel 120. This fold line 138 may be a smooth transition or a rounded corner instead a right angle edge. Projecting back toward the rear panel 122 within the top panel 114 is an upper opening 140. The upper opening generally forms a substantially concave perimeter 142, relative to the fold line 138. The other portion of the opening 130 projects downwardly toward the bottom panel 116 within the front panel 120 providing a forward facing opening 144. The central section of the forward facing opening is also substantially concave relative to the fold line 138 forming a valley 146 generally defining a front facing perimeter 148. Together, the upper perimeter 142 and the front facing perimeter 148 cooperate to define the opening 130 or mouth leading to the article storage chamber 124. The upper perimeter and front facing perimeter meet at the fold line 138 in this exemplary embodiment. In general, the upper perimeter 142 includes a smaller radius of curvature across the concave region compared to the larger radius of curvature across the concave region of the front facing or lower perimeter 148. As the perimeters approach one another, the overall size of the opening 130 converges on each lateral side to a left side narrow gap 151 terminating at the extreme left end 150 of the opening near the edge of the left side panel 119 and a right side narrow gap 153 terminating at the extreme right end 152 of the opening near the edge of the right side panel 118.

In the exemplary embodiment of FIGS. 3A-3C, the panels of the dispenser 110 are made from soft plastic film defining the article storage chamber 124. The use of plastic film reduces the contaminant from cardboard dust. As shown in FIGS. 3B-3C with the cut-out 136 removed, contained within the article storage chamber 124 is at least one self-opening bag stack 128*a*, with a handle section 168*a* resting in an easy-to-dispense configuration with the handles disposed proximate the opening 130 like a tongue hanging out of a mouth. In this exemplary embodiment, the outermost handle of an outermost bag has either been pulled or slid off the rest of the folded article stack 128*a* or an outermost bag removed leaving the handle section 168*a* with handle opening 169*a* of the subsequent bag extending outside the article storage chamber 124 and residing immediately below the top panel 114 outside the opening 130 to expose the die-cut handle of the topmost bag 126*a* for ready dispensation. Alternatively, the handle sections, even of the outermost bag, may rest atop the remainder of the folded article stack 128*a* still within easy reach through the opening 130 as with the prior embodiments.

The cut-out lines or perforations 142 and 148 are typically formed in the top panel and adjoining front panel, which when the perforation's tit connections are broken, the entire cut-out 136 may be removed to define the dispenser opening 130 as illustrated in FIGS. 3B-3C. These perforated lines 142, 148 are typically fabricated when dispenser 110 is manufactured and forms the cut-out opening 136, which may be subsequently extracted by a user by tearing it at perforations 142 and 148, thus preparing the dispenser's contents for dispensing. The dispenser cut-out 136 of the present invention may be made on most common film converting lines during the manufacturing process of the dispenser. While the dispensing cut-out'136 in FIG. 3A and the corresponding dispenser opening 130 in FIGS. 3B-3C may be a preferred embodiment for the soft-walled dispenser 130 illustrated herein, it is not necessary to have rounded cut-out corners and lines. Straight, rectangular lines or a combination of straight and rounded lines may suffice in many applications. In some applications, a single slit or two dissecting perpendicular lines may form a desirable dispenser with the desired effect. Likewise, the dispenser opening may be located on any one or more panels based on where the desired dispensing operation shall occur, and based on the manufacturing process of the dispenser. Similarly, the dispensing opening size and location will depend on the bag or article being dispensed, its weight, material, size, configuration, and so on. Instead of a plurality of panels, a single panel such as a soft-film tube may be used as the dispenser with the opposing ends then sealed after the folded article stacks are placed in the article storage chamber defined by the tube. In addition, as with all embodiments described herein, the cover 136 may overlap the opening 130 instead of being complementary and may be removably adhered to the dispenser panel area surrounding the opening such that peeling off the cover exposes the opening.

E. Description of Exemplary Folded Article Stacks

In FIGS. 3B-3C, the cut-out 136 of dispenser 110 of FIG. 3A has been completely removed allowing the underlying topmost bag 126*a* of bag stack 128*a* to be located at or near the cut-out opening 130, ready for a user to grasp and dispense. As illustrated a topmost bag handle 168*a* has "popped up" outside opening 130 ready to be grasped and dispensed by a user, with the top of opposing topmost handle section 168*b* and handle opening 169*b* still inside the dispenser. The configuration of soft-walled dispenser 110 is such that the underlying bag stacks 128*a* are either flat or folded in a non-binding manner in the tri-fold or bi-fold configurations as described above with the tail sections tucked underneath the head or main body sections, whereas the bag handles, bag tops (or bottoms as the case may sometimes be), are disposed in a position that allows clear access by a user to grasp said handles and tops and intuitively know how to dispense the internal bags. Likewise, in the case of sheet or tissue articles, the graspable tops, lips, or fold-over sheet portions shall be positioned adjacent the dispenser opening for easy, intuitive extraction by the user.

In the exemplary configuration shown in FIG. 3C, it is assumed that one-half of the bags 126 in the internal bag stack 128*a* have been dispensed from the dispenser 110 of FIGS. 3A-3B. As the article storage chamber 124 of the dispenser 110 is preferably filled with one or more bag stacks prior to use to maximize the article count and storage space provided by the article storage chamber and at least the top panel 114 is constructed of a soft plastic film, removing one or more articles 126 from the folded article stack 128*a* results in collapsing or sagging of the top panel 114 atop internal bag stack 128*a* as side gusset regions 121 and 125 also collapse downward. In doing so, the topmost bag 126*a* of the folded article stack 126*a* is always positioned just below and adjacent to or in contact with the top panel 114 and the perimeter 142 of the opening 130. This unique self-collapsing system automatically allows a top bag (or sheet article, etc.) to be easily and quickly grasped, without reaching inside the dispenser as would be required with a rigid cardboard carton. This significantly improves the ease and speed of dispensing bags and articles, one at a time.

Typically when using self-opening bags, the perimeter 142 of the opening 130 in the top panel 114 (or at times a front or side surface) serves as a separator as described in our co-pending '191 publication that assists in separating the front handle from the rear handle of a single bag as well separating the rear handle of an outermost bag from the interconnected front handle of an adjacent bag. In such a case, a top handle or upper portion of a sheet article is always disposed atop the outer surface of the dispenser, which serves as the separator and indexes each subsequent bag for dispensing after an outermost bag is removed.

Figure 3D:
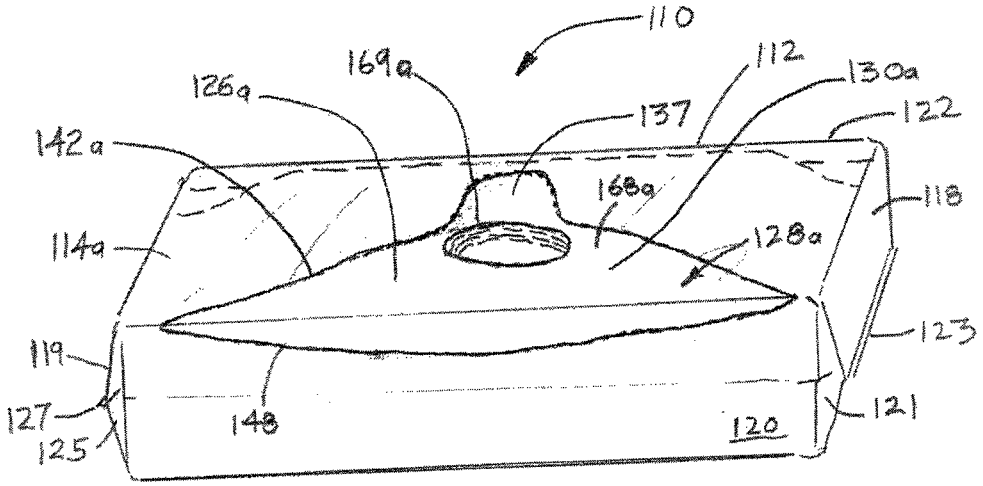
FIG. 3D is a similar view to that of FIG. 3B, in enlarged scale, with an alternative larger dispenser opening primarily for use with non-self-opening bags and sheet articles that do not pop up.

Referring now to FIG. 3D, the dispenser 110 is filled in this exemplary embodiment with non-self-opening bags includes a modified opening 130*a* shaped slightly different than those of the previous dispensers in that the opening 130*a* has a modified upper perimeter 142*a* with an enlarged finger cut-out area 137 positioned to extend rearwardly along the top panel 114*a* to a point beyond the handle opening 169*a* of the underlying die cut handle section 168*a*. This allows a user to easily swipe his finger through the enlarged finger cut-out area 137 and onto the handle section 168*a* of the outermost bag 126*a*, sliding the top portion 168*a* of the topmost bag 126*a* toward the front panel 120 and extract the bag handle 168*a* and in turn extracting the outermost bag 126*a* through dispenser opening 130*a*, much like that illustrated in FIGS. 3B-3C. If using non self-opening bags, the outermost bag 126*a* will be dispensed from the dispenser 110 without the self-opening, pop-up effect and the subsequent handle of the next outermost bag in the bag stack 128*a* may remain flat on the bag stack. In such a case, all subsequent bags are dispensed by swiping the fingers over a top portion, or pinching the top bag ply surface, and extracting the bag. On the other hand, self-opening bags will typically pop out and index their outermost handles outside the opening. While not shown in FIG. 3D, it will be appreciated that the cutout region may be a complementary shape or simply be a peel off portion covering the opening 130*a* prior to use.

F. Other Alternative Embodiments

Figure 4A:
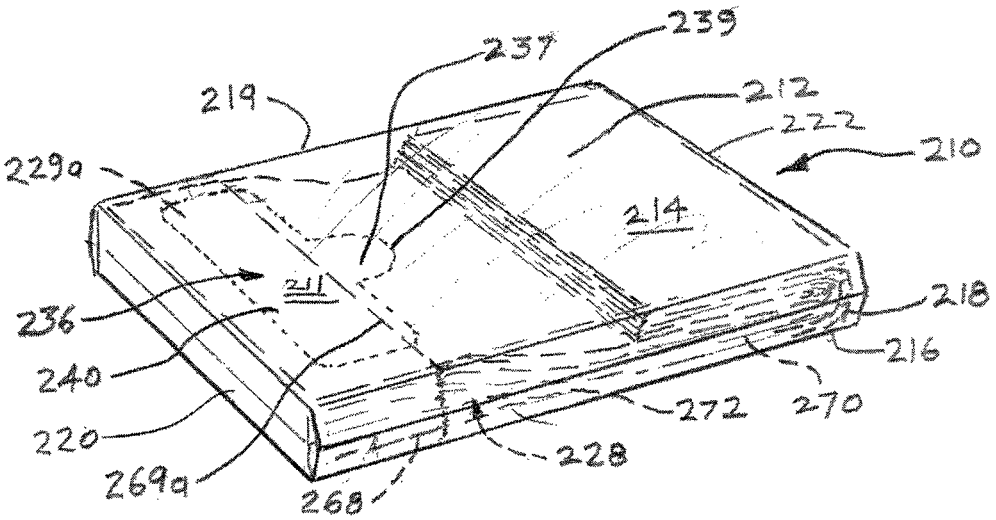
FIG. 4A is an upper right perspective view of the dispenser shown in FIG. 3D, in different scale, illustrating how non-pop up sheets may be packed.
Figure 4B:
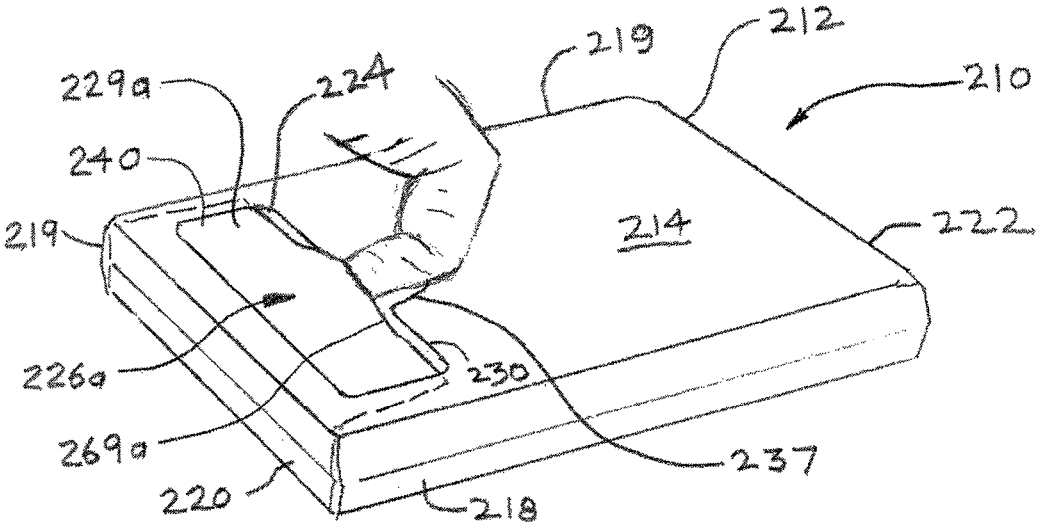
FIG. 4B is a similar view to that of FIG. 4A, illustrating how a non-pop up sheet may be dispensed.
Figure 4C:
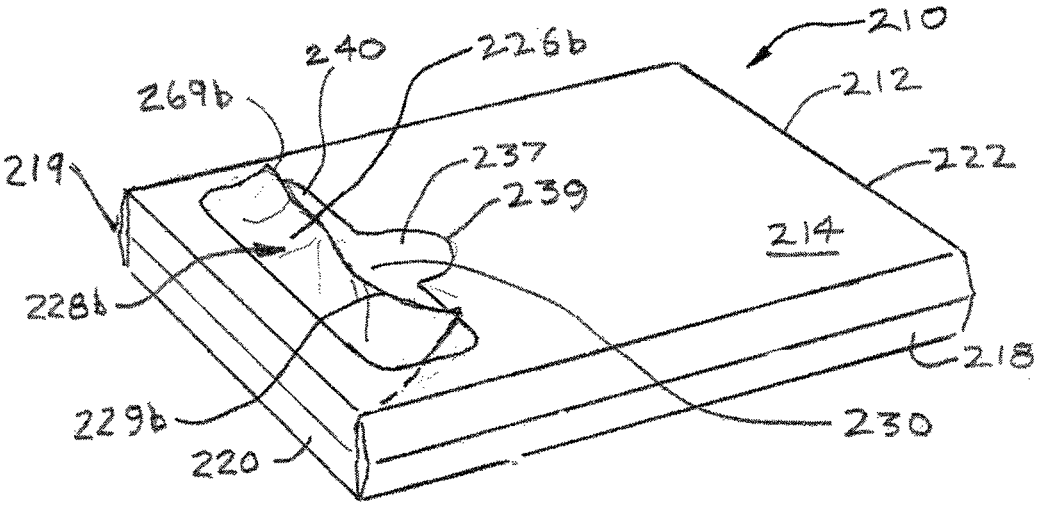
FIG. 4C is a similar view to that of FIG. 4B illustrating the topmost interconnected sheet disposed above the dispenser opening.

Turning now to FIGS. 4A-4C, another exemplary embodiment constructed in accordance with the principles of the present invention is illustrated. In this embodiment, a dispenser, generally designated 210, is made from plastic film and consists of a top panel 214, an opposing bottom panel 216 (outer right edge shown), a right side panel region 218 and an opposing left side panel 219, a front panel 220 and an opposing rear panel 222 (top edge shown). As with prior embodiments, the panels cooperate to define an article storage chamber 224. In addition, the top panel 214 includes a cut-out opening 230 covered by dispenser cut-out panel 236 (FIG. 4A) defined by perforated line 242 that forms the cut-out opening 230 (in FIG. 3F) that includes a generally rectangular shaped, primary extraction site region 240 and a semi-circular, finger slot extension 237 with an rearmost extent 239.

The dispenser 210 may be filled with a stack of non-pop-up sheets 228. As shown in dashed lines in FIG. 4A, the sheet stack 228 includes a head section 268, a tail section 270, and a main body section 272 spanning between the outer head and opposing tail sections. The head section of each individual sheet 226 includes pre-folded lips 229*a* (uppermost lip shown in FIG. 4B) that are aligned with adjacent sheets. In other words, the sheets are all aligned in the same direction. In FIGS. 4A-4B, the tissue stacks 228 are illustrated with the rearmost edge 269*a* of a topmost pre-folded lip 229*a* exposed inside or near the finger slot 237. This provides easy access by a user to index a top-most pre-folded lip 229*a*, grasp the lip 229*a*, and then withdraw the topmost sheet 226*a*. Once withdrawn, the next non-pop-up sheet with its pre-folded lip becomes the topmost sheet. In this exemplary embodiment, the bottom edges of the tails of the tail section 270 are aligned and folded up onto the main body section 272 as illustrated in dashed lines in FIG. 4A. This allows the topmost sheet 226*a* to easily dispense through opening 230 (FIG. 4B). As with other stacks described herein, the tail sections may also be tucked underneath the head or main body sections of the tissue stack 228.

In FIG. 4B, the dispenser 210 is illustrated with the dispenser panel 236 (see FIG. 4A) removed creating dispenser opening 230, and with a user's finger 290 slipped underneath rearmost edge 269*a* of the uppermost sheet 226*a* in finger slot space 237, allowing the topmost lip 229*a* to be grasped by the user's fingers and withdrawn through dispenser opening 230. Continual withdrawal extracts the entire topmost sheet 226*a*, whereas the underlying sheet then becomes the topmost sheet, readily available for a subsequent dispensing. This type of dispensing operation would be preferable to an interleaved sheet when the dispenser is placed under a shelf with relatively short headroom simply due to the fact that this type of dispensing operation may occur from the end of the dispenser. This type of dispenser may be suitable for any number of non-bag and non-sheet articles that would otherwise be extracted from a shipping carton in a one-at-a-time manner, including bags or sheets on a roll. In such a case, the dispensing process may not rely on the indexing of an end of a sheet or article, but would simply rely on providing access to a user who can reach into the dispenser opening and grasp a topmost article.

In FIG. 4C, dispenser 210 is essentially the same as that of FIGS. 4A-4B in its open disposition, however the dispenser is filled with interconnected pop-up sheets 226*b*, made in more or less the same size and configuration as the pre-folded sheets 226*a* in FIGS. 4A-4B. In this case, the top pre-folded lip 229*b* of topmost sheet 226*b* automatically pops out of dispenser opening 230 when a subsequent sheet is dispensed, with its rearmost edge 269*b* exposed outside dispenser opening 230, thus ready for the user to grasp and withdraw. The dispensing of each topmost sheet automatically pops-up the nest sheet in sequence much like the interconnected sheets disclosed in our '191 publication. As with the prior soft-walled dispensers 110 (FIGS. 3A-3D) and dispenser 210 in FIGS. 4A-4B, the side panels 218, 219 of the dispenser 210 in FIG. 4C are gusseted and are constructed to collapse and lower the top panel 214 as each sheet from the sheet stack 228*b* is withdrawn maintaining the opening 230 in close proximity with the head section 268 of the uppermost or outermost sheet in the stack 228*b* speeding up the withdrawal process.

G. Exemplary Dispenser Manufacturing and Loading Process

Figure 5A:
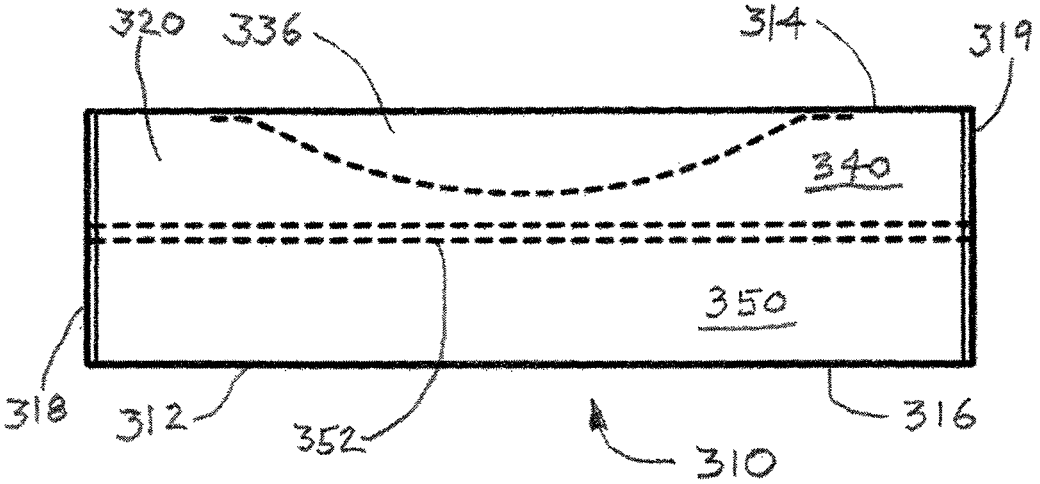
FIG. 5A is a plan view of an alternative embodiment of a dispenser with a self-closing side gusset constructed in accordance with the principles of the present invention.

Referring now to FIG. 5A, another exemplary embodiment of a dispenser, generally designated 310, and constructed in accordance with the principles of the present invention is similar to the dispenser 110 in FIGS. 3A-3C and includes a dispenser body 312 manufactured on a twin seal bag machine to include a front panel 314, a rear panel 316, a right side panel 318 and opposing left side panel 319, a top panel 320, and bottom panel 322. In addition, the right side panel and left side panels include two opposing side gussets, 321, 323, respectively, while the top panel 320 includes a narrow side gusset 340 adjacent the front panel 314 and a wide side gusset 350 adjacent the rear panel 316 (FIG. 5A). In this exemplary embodiment, the wide side gusset 350 is slit along the entire length of a crease 352 running through a centerline and is one-eighth of an inch wider than the narrow side gusset 340. The dispenser opening perforation 336 that may be removed to provide the opening into the article storage chamber 324 may be introduced upstream from the twin seal operation on the bag machine, typically by a rotary perforation wheel. The perforation wheel would be in register with the twin sealing operation and may likewise be in registration with printed matter on the dispenser, for example, "Open bag dispenser here".

Figure 5B:
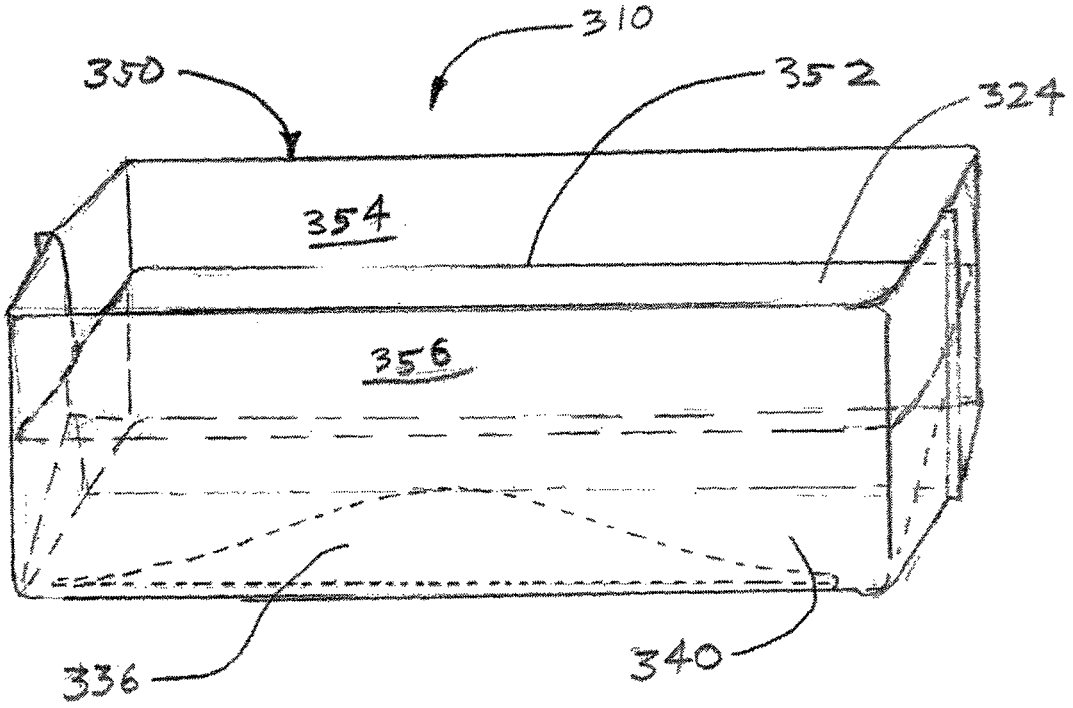
FIG. 5B is an upper right perspective view of the dispenser in FIG. 5A in an open configuration (rear side up) ready for loading with articles.

In FIG. 5B, the dispenser 310 is depicted in an open disposition to allow the loading of bags or articles, such as the folded article stacks or sheets described above, with the narrow gusset side 340 placed atop a countertop, and bloused open along the wide gusset side 350 due to slit-open center crease 352 of the wide gusset side, with a set of two side gusset portions 354 and 356 neatly tucked inside. In this open disposition, dispenser 310 may now be filled with folded bag packs (not shown) with their handle regions positioned towards cut-out region 326 with the outermost article adjacent the cut-out region. This method of filling bag contents in dispenser 310 of the present invention may be augmented by having a jig in which the dispenser is placed inside, whereas the jig maintains the dispenser in an open disposition, and contents may be rapidly filled by hand. This process—or many others for that matter—used with the present invention may also be automated in part or full.

Figure 5C:
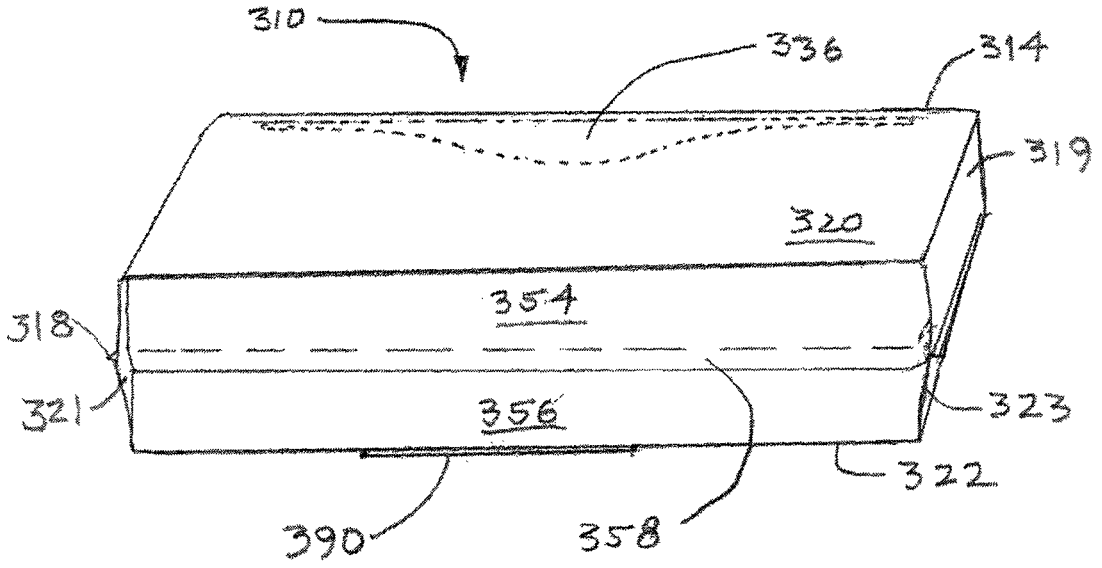
FIG. 5C is a perspective view of the self-closing dispenser of FIGS. 5A-5B with the rear panel facing forward and illustrating the slit side gussets in a closed disposition.

In FIG. 5C, the dispenser 310 of FIGS. 5A-5B has been filled with an article stack and is quickly closed by doing nothing more than pulling outward the two portions 354 and 356, whereas they will naturally overlap, with film overlap 358 acting as a closure with its contents secured inside. If desired a small piece of tape may be applied as a final closure, but would not necessarily be required. With this overlapping closure, there are further savings and less waste generated by eliminating the carton or sealing tape.

H. Adhesive and Non-Slip Variations

As for example illustrated in FIG. 5C, and the various dispensers described herein may also include a non-slip area 390 on the outer surface of at least one panel. In most instances, the selected outer surface will be the panel opposite the panel with the opening or extraction site. This non-slip area may be provided by an adhesive, a sticky surface, a non-skip material, magnetic element, or other suitable surface texture or material, which may serve one or more purposes. For example, this non-slip area may be in the form of a peel-off adhesive tab on the bottom of the dispenser, whereas a user may firmly affix the dispenser in place on a shelf. This region 390 may also be an adhesive used to palletize the filled dispenser, whereas the dispenser doubles as a shipping container. This region 390 may also include the use of a special releasable and re-stick-able adhesive that has a first purpose as a means to palletize the filled dispensers on a pallet, and; a second purpose of sticking a filled dispenser securely atop a countertop or on a shelf in a store. Such type of adhesive may be similar to that used on Post-It® notes, and of that manufactured by the Lock n' Pop company, #3283 and P1-E. These adhesives are water-based, and after applied to a surface on a plastic dispenser, quickly dry into a flexible, sticky, solid state. When stuck down and re-stuck on a countertop and so on, no residue is left, again much like that of a common Post-It® note. The amount of adhesive that is applied is determined by the weight of the filled dispenser, and its subsequent palletization. It may be as small as one to two quarter inch dots of adhesive on the bottom surface up to several one inch patches on a larger, heavier package. It will be appreciated that the non-slip area, if an adhesive or magnetic material may also be used to mount and support the dispenser at an elevated angle, a vertical wall, or even upside down for dispensing articles out of dispensers in orientations other than a flat surface.

Related to the foregoing, the dispensers constructed in accordance with the principles of the present invention may be made from a non-slip material such as that which is commonly used with bulk shipping sacks. They may be made of essentially any type of plastic material, but preferably one with high tactile property that assists in helping the dispenser to stay put atop a counter or shelf during the dispensing process. The material should also be one that allows the dispenser to collapse effectively, such as thinner polyethylene and polypropylene films in the two to four mil range. For reference, dispensers made in a gauge of four mils will typically cost about one-fifth that of a comparable cardboard carton and represents a substantial cost reduction. This can be as great as $500-$800 per truckload, which likewise reduces space requirements for storage and the recycling of packaging material.

I. Palletization of the Dispensers

When larger dispensers of the present invention are palletized, the palletization would typically be done in a similar manner to the palletization of ordinary bulk plastic shipping sacks filled with sand, grain, or otherwise. In such a palletization, the present invention dispensers would be interlocked and stacked, and finally wrapped with stretch wrap. Palletization as such may then be stacked as high as three-high, which is desirable by warehouses and shippers. By eliminating heavy, bulky cardboard (in comparison to the cost of the dispenser of the present invention), it allows manufacturers to ship additional goods and reduce freight costs. For recipients of those goods, it likewise represents lower costs, and much less cardboard waste. The plastic dispensers and stretch wrap is easy and very economical to recycle, whereas the paperboard used for cartons is relatively expensive to recycle and takes up substantially more warehouse space.

One other variation on the dual-purpose theme is the packaging of smaller dispensers, for example one hundred to two hundred fifty small food bags (or similar lightweight sheeting articles) that may weigh only one to three pounds. In such a case, they would replace a chipboard box, and the dispensers may then be packed inside a master carton in units of ten to thirty or more. The master cartons are palletized, and shipped to an end user. End users may then withdraw a single unit from the carton, by unsticking it from the unit below, and re-sticking to a countertop or shelf for subsequent use.

J. Additional Alternatives and Uses

The dispensers constructed in accordance with the principles of the present invention may be used equally with bags, sheets, and tissues, preferably having at least one folded region as with the tri-folded and bi-folded arrangements to reduce the overall profile of the dispensers and maximize the bag count versus internal space. The sheets described herein may have fold-over lips, or none at all. The lips may be interconnected and may be extracted much like those bags previously described. The methodology described herein may also apply to pick up tissues, placemats, even plastic film taco and sandwich wraps. Likewise other soft-fold accordion-like methodologies such as four-fold and even five-fold may apply with the similar result of allowing a plastic article to be extracted with minimum resistance. This may certainly be the case with longer bags, for example umbrella bags extracted from the end of a dispenser carton.

As for the bags described herein, the nature and spirit of the present invention is such that the dispensers may be used on most types of traditional flat-topped, wave-top, and bell-top bags, small and large, side-gusseted, bottom gusseted, or no gussets. Smaller bag packs may be packed side by side or end to end. Bags may be dispensed from the long or short sides of a carton, depending on bag size, length and gusset configuration. At times it may be beneficial to extract certain bag types bottom first. As for articles dispensed from the dispensers of the present invention, bags may be of any variety or types, for example with or without handles, flat, side or bottom gusseted, self-opening or non-self-opening, in virtually any thickness, material, and folded or unfolded, or on a roll. Sheet articles may be flat, folded, with a lip, even interfolded, and with or without a pop-up feature and interconnections. However, the dispensers constructed in accordance with the principles of the present invention are not limited to bags and sheets. Other articles may be dispensed of any number of items that require extraction of its contents, which is typically in a one-at-a-time manner. The dispensers and systems of the present invention work effectively for all types of bags, self-opening and non-self-opening, side gusseted, flat or bottom gusseted, stacked sheet or on a roll, with or without handles, and sheet-type articles of any size and configuration, by loading the bag and article packs in a cooperating dispenser in a unique non-binding manner. More interesting is that the dispensers allow users to dispense bags in various ways and behaviors, including dispensing from atop a counter or on a shelf below a counter. All the while, one-at-a-time dispensing and sanitation may be significantly improved.

There are truly few limits to size and configuration of this dispenser that can efficaciously dispense almost any size and gauge of sheet or bag. The dispensers and systems of the present invention work effectively for all types of bags, self-opening and non-self-opening, side gusseted, flat or bottom gusseted, high and low density, with or without handles, by loading bag packs in a cooperating dispenser in a unique non-binding, soft-fold accordion-like manner. More interesting is that the dispensers allow users to dispense bags in multitude of ways and behaviors, including: 1)

dispensing from atop a counter; 2) dispensing from a shelf below a counter; 3) dispensing by grasping one or more bag handles; 4) allowing a user to extract a stack of handles from the box and subsequently dispense bags one at a time; 5) dispensing a bag handle and extracting the bag by pulling it out in the opposite direction; 6) all the while allowing the user to open the box, so a stack of bags may be extracted or used on a metal dispenser or otherwise; and 7) all the while one-at-a-time dispensing and sanitation may be significantly improved. It is also easy to see that the same principles that apply to bags dispensed from the present invention may inherently apply to sheets and other plastic bag articles.

The rigid dispensers constructed in accordance with the principles of the present invention may also be made of chipboard, plastic, or perhaps in a more permanent structure, such as metal or wood. It may be large enough to contain pallet covers, or small enough to contain small fasteners or jewels. More important, the dispenser carton of the present invention can be manufactured in the most cost-effective format, as a traditional RSC carton. This provides a substantial added value as the cartons may be as much as 50% lower in cost than the traditional dispensers with the larger footprint.

It is also important to note that dispensers of the present invention may be made from many types of converting operations, including sideweld, bottom seal, and twin seal operations. It may also be formed from sheeting, such as L-sheeting, C-fold sheeting and the like. After a dispenser is filled with bags or articles, it may then be sealed closed by many forms including the overlapping gussets disclosed herein, heat sealing, tape, adhesive, and so on. More important, the dispenser of the present invention may be manufactured in a cost-effective format from plastic film at about one-fifth the cost of a traditional RSC carton, and one-tenth the cost of a traditional dispenser carton. One variation eliminates the requirement to use tape or a heat seal to close the package. The dispenser of the present invention efficaciously dispenses bags and articles due to its self-collapsing nature. In doing so, a topmost article is always adjacent the dispenser opening, ready to be extracted.

Consistent with the spirit of the present invention, interconnected self-opening and non-self-opening articles—gusseted and non-gusseted bags, tissues, sheets and the like—may be efficaciously dispensed from space-saving cartons with or without self-collapsing features that contain cooperative dispenser openings that allow one at a time dispensing, with or without the use of a front or top panel as a separator, and where the topmost article is preferably always adjacent the opening within easy grasp of a user, and regardless of bag, sheet, or article type. In addition, the cut-out configuration of a dispenser constructed in accordance with the principles of the present invention may be located anywhere on a top, bottom, front, rear, or side panel, or combination of panels provided the cut-out removal allows a topmost or outermost bag to be extracted through the opening with minimal resistance. It may be in the form of an opening as disclosed herein, or a simple slit, perpendicular slits, or otherwise.

The dispensers and dispensing systems of the present invention may be mounted horizontally, vertically, even upside-down (in which case the topmost bag may become a bottom-most bag). Regardless of how contents are dispensed and where dispensers are placed are considered under the scope of the present invention. The spirit of the present invention provides a breadth of scope that includes all dispensing of bags and articles through all cooperative dispenser configurations, regardless of construction type. It also covers broad methodologies of automating, partially or in whole, the loading of the bags and articles into a dispenser of the present invention. Any variation on the theme and methodology of accomplishing the same that are not described herein would be considered under the scope of the present invention.

It is an objective of this application to illustrate various preferred embodiments of the universal, space-saving dispenser, and its methods of dispensing bags, tissues, and other plastic articles, and to broadly state the methodologies that may be used in order to efficaciously dispense all types of bags and articles. The dispenser of the present invention efficaciously dispenses bags and articles with or without the self-collapsing features. However, using the self-collapsing feature ensures a topmost article is always adjacent the dispenser opening, ready to be extracted. It is an objective of this application to broadly illustrate various preferred embodiments of the collapsible dispenser, the methods of dispensing bags and articles, methods to load the dispensers, methods to palletize and ship them, and methods to manufacture the dispensers. It is an objective of this application to broadly illustrate various preferred embodiments of the collapsible dispenser, the methods of dispensing bags and articles, methods to load the dispensers, methods to palletize and ship them, and methods to manufacture the dispensers.

The dispensing operation of the bags of the present invention is also natural, instinctive to users, as they dispense articles much like they would a traditional bag from a box, or perhaps a facial tissue from a box or the small plastic package used for inter-leaved tissues. The present invention dispenser is easy for employees to know how to open and use, as it incorporates a traditional perforated opening, but in a special configuration that delineates the unique dispensing qualities illustrated herein. Whether bag, tissue, sheet or otherwise, the dispensing operation of the present invention is intuitive, no training is required.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. Thus, it is intended that the scope of the present invention herein disclosed should not be limited by the particular disclosed embodiments described above.

What is claimed is:

1. A universal space-saving dispenser for storing a plurality of articles to be dispensed one at a time comprising:

a dispenser body including a horizontally projecting bottom panel, an opposing top panel, a pair of opposing side panels, and a pair of opposing front and rear panels with the panels bounding an article storage chamber;

an article extraction site having at least a portion projecting within the top panel and leading to the article storage chamber; and at least one stack of elongated articles of a predetermined length being folded over at least once in a non-binding arrangement with a lowermost planar section having a first free end tucked under an uppermost planar section having a second free end with at least one curved section therebetween, the sections cooperating to define a folded article stack with an outermost article and an innermost article with each article in the folded article stack having a retrieval end oriented in the same horizontally projecting direction and facing the rear panel of the dispenser body, the folded article stack being disposed within the article storage chamber with the uppermost planar section projecting substantially parallel to the top panel, the lowermost planar section resting on and projecting substantially coextensively with the bottom panel of the dispenser body with the planar sections defining a majority of the predetermined length of the elongated articles, and the retrieval end of the outermost article of the folded article stack disposed within or proximate the extraction site, the outermost article being constructed to slide off the folded article stack in a substantially horizontal direction without binding on an adjacent article and out through the extraction site when pulled by the corresponding retrieval end while leaving the retrieval end of an adjacent article in the folded article stack exposed through the extraction site for subsequent withdrawal of the adjacent next article from the folded article stack wherein each article of the folded article stack may be selectively withdrawn in a substantially horizontal direction one at a time through the extraction site until the innermost article is removed from the article storage chamber.

2. The dispenser of claim 1 wherein:

the stack of elongated articles includes a head section, an opposing tail section, and an intermediate section therebetween, and the lowermost planar section is the tail section tucked under at least one other section.

3. The dispenser of claim 1 wherein:

the extraction site includes a first portion projecting into the top panel and a second portion projecting into the front panel.

4. The dispenser of claim 1 wherein:

the dispenser body is a carton with a plurality of rigid panels bounding the article storage chamber.

5. The dispenser of claim 1 wherein:

the dispenser body includes a collapsible top panel constructed to maintain at least a portion of the extraction site in close proximity with the retrieval end of the outermost article in the folded article stack, the dispenser body further including a pair of opposing side panels with gussets that collapse and lower the collapsible top panel to maintain contact with the uppermost surface of the remaining folded article stack after each article is withdrawn from the article storage chamber.

6. The dispenser of claim 1 wherein:

the dispenser body includes at least two panels with a common edge; and the extraction site includes an opening projecting through adjacent portions of the two panels, the opening including a first perimeter in one panel relative to the common edge and a second perimeter in the other panel also relative to the common edge with the outermost regions of the perimeters converging together, wherein only a top ply of the retrieval end of each article is left in a position proximate the extraction site after withdrawal of an adjacent outermost article from the folded article stack.

7. The dispenser of claim 1 wherein:

the outer surface of at least one panel includes a non-slip material constructed to releasably retain the dispenser body on a support surface while individual articles are being withdrawn one at a time from the article storage chamber.

8. The dispenser of claim 1 wherein:

the stack of articles includes individual articles with a retrieval end and a distal end;

the folded article stack within the article storage chamber are folded into an S-shaped configuration with the uppermost surface of the stack being substantially flat and parallel to the top panel of the dispenser body and the lowermost surface of the stack being substantially flat and parallel to the bottom panel of the dispenser body and at least one curved section introduced by folding adjacent the front panel and at least one other curved section introduced by folding adjacent the rear panel, the stack further oriented within the dispenser body with the retrieval ends and opposing distal ends of each article pointing in generally opposite directions with the uppermost portions of the retrieval ends facing rearwardly toward the rear panel and proximate the portion of the extraction site projecting within the top panel.

9. The dispenser of claim 1 wherein:

the adjacent folded articles within the folded article stack are separably interconnected.

10. The dispenser of claim 1 wherein:

at least one panel of the dispenser body is constructed of a plastic film.

11. The dispenser of claim 1 wherein:

the dispenser body includes at least one panel constructed of a plastic film defining at least one gusset open on one side for insertion of a folded article stack.

12. The dispenser of claim 1 wherein:

the articles are bags with each bag having with a bag mouth and at least one handle extending from an uppermost top panel of the bag providing the retrieval end of each bag, the handle having a vertically accessible handle aperture disposed horizontally in same plane as the uppermost top panel and disposed proximate the bag mouth.

13. The dispenser of claim 12 wherein:

the bags are self-opening when withdrawn from the article storage chamber.

14. The dispenser of claim 1 wherein:

the retrieval end of the outermost article of the folded article stack includes a weak bond to the retrieval end of an adjacent article with the weak bond being severed during withdrawal of the outermost article due solely to the sliding of the outermost article away from the adjacent article within the remaining folded article stack.

15. The dispenser of claim 14 wherein:

the weak bond between adjacent articles is constructed to be sufficiently strong to raise the retrieval end of the adjacent article through the opening as the outermost article is being withdrawn but further constructed to release the adjacent article once the retrieval end of the adjacent article has cleared the extraction site and is outside the article storage chamber.

16. A stack of articles for insertion into a universal space-saving dispenser having an article storage chamber bounded by a horizontally projecting bottom panel, an opposing top panel, a pair of opposing side panels, and a pair of opposing front and rear panels with an extraction site having at least a portion projecting within the top panel and leading to the article storage chamber, the stack of articles comprising:

a plurality of elongated articles of a predetermined length with each article including a head section with a retrieval end, a distal end section, and an intermediate section therebetween, the plurality of articles being oriented in the same direction and then folded over at least once in a non-binding arrangement to define a folded article stack with a lowermost horizontally projecting planar section tucked under at least one other substantially horizontally projecting planar section and defining an outermost article and an innermost article with the folded article stack constructed to be inserted into the article storage chamber with at least one planar section adjacent and substantially parallel to the top panel, the other substantially planar section resting on and projecting horizontally and substantially coextensively with the bottom panel and with the retrieval end of each article pointing toward the rear panel with at least two of the horizontally projecting planar sections directly abutting one another with no gaps therebetween and defining a majority of the predetermined length of elongated articles, and at least one curved section introduced by folding disposed adjacent the front panel and with the outermost article having its retrieval end disposed proximate the extraction site, the retrieval end of the outermost article being constructed to be withdrawn first through the extraction site with the outermost article sliding off the folded article stack in a substantially horizontal direction without binding with an adjacent article in the folded article stack while leaving the retrieval end of the adjacent article in the folded article stack exposed to the extraction site and resting in a substantially parallel orientation relative to the top panel for subsequent withdrawal wherein the articles may be selectively withdrawn in a substantially horizontal direction one at a time through the extraction site until the innermost article is removed from the article storage chamber.

17. The stack of articles of claim 16 wherein:

the articles are bags with each bag including a gusset along the bottom edge to assist the bags in standing when opened and a pair of handles proximate the open mouth region with at least one handle defining the retrieval end, the bags further being separably attached by adjacent handles at or adjacent the retrieval end to other adjacent bags in the stack by a bond that is constructed to raise the uppermost handle of the retrieval end of an adjacent bag as a most proximate bag is withdrawn through the opening but sever a connection between adjacent bags prior to the lowermost handle of the retrieval end of the adjacent bag exiting the extraction site.

18. The cartridge of claim 16 wherein:

the articles are sheets, each sheet being separably attached to an adjacent sheet by a common edge, the retrieval ends of the sheets being folded over.

19. A method of dispensing an article one at a time from a universal space-saving dispenser comprising the steps of:

providing a dispenser body having a horizontally projecting bottom panel, an opposing top panel, a pair of opposing side panels, and a pair of opposing front and rear panels with an opening with at least a portion projecting within the top panel and leading to an article storage chamber;

providing at least one stack of elongated articles of a predetermined length folded over at least once in a non-binding arrangement with a first horizontally projecting planar section having a first free end and tucked under a second horizontally projecting planar section having a second free end to define a folded article stack with each article in the stack having an outermost surface terminating in a retrieval end and an opposing distal end and disposed in the same retrieval end to distal end orientation as an adjacent article;

disposing the folded article stack within the article storage chamber with at least one planar section adjacent and substantially parallel to the top panel, the other planar section resting on and projecting horizontally and substantially coextensively with the bottom panel with the retrieval end of each article pointing toward the rear panel and the horizontally projecting planar sections defining a majority of the predetermined length of the elongated articles, and at least one curved section introduced by folding adjacent the front panel and with an outermost article closer to the opening than an innermost article with the outermost surface of the outermost article disposed proximate the opening;

sliding the retrieval end of the outermost article off the folded article stack in a substantially horizontal direction and out through the opening;

withdrawing the outermost article off the folded article stack out through the opening by pulling only the top ply of the rearward facing, uppermost article portion forward and out through the extraction site in a horizontal direction substantially parallel to the top panel;

leaving the retrieval end of the next uppermost article in the folded article stack in a rearward facing disposition wherein upon the subsequent withdrawal of the next uppermost article off the folded article stack is also completed by withdrawing only the top ply of the next uppermost article forward and out through the extraction site in a substantially horizontal direction; and selectively withdrawing the articles one at a time out through the opening in a substantially horizontal direction until the innermost article is removed from the article storage chamber.

20. The method of claim 19 further comprising the steps of:

providing the articles in the form of a bag wherein the rearward facing, uppermost article portion is the topmost bag ply;

grasping the retrieval end of the topmost bag ply of the outermost bag;

withdrawing only the topmost bag ply of the outermost bag to open the bag for subsequent loading; and indexing the outermost retrieval end of the next bag in the sequence in a subsequent withdrawal position.

21. A method for pre-loading a universal space-saving dispenser of articles comprising the steps of:

providing a dispenser body having a horizontally projecting bottom panel, an opposing top panel, a pair of opposing side panels, and a pair of opposing front and rear panels with an extraction site having at least a portion projecting within the top panel and leading to an article storage chamber;

providing at least one stack of elongated articles of a predetermined length folded over at least once in a non-binding arrangement to define a folded article stack with a first substantially planar section tucked under a second substantially planar section and with each article in the stack having an outermost surface terminating in a retrieval end and an opposing distal end and disposed in the same orientation as an adjacent article;

permanently affixing at least two panels together leaving at least one opening through which the folded article stack may be inserted into the article storage chamber; and inserting the folded article stack into the article storage chamber with at least one substantially planar section adjacent and substantially parallel to the top panel, the other planar section resting on and projecting horizontally and substantially coextensively with the bottom panel with the planar sections defining a majority of the predetermined length of the elongated articles, the retrieval end of each article pointing toward the rear panel, at least one curved section introduced by folding adjacent the front panel, and with an outermost article closer to the extraction site relative to an innermost article with the retrieval end of an outermost surface of the outermost article disposed proximate the opening.

22. The method of claim 21 further comprising the steps of:

providing at least one openable gusset with overlapping portions and a slit opening therebetween in at least one panel of the dispenser body leading to the article storage chamber;

blousing open the openable gusset;

inserting the folded article stack into the article storage chamber through the slit opening; and closing off the openable gusset by bringing the overlapping portions together.

23. A universal space-saving dispenser for storing a plurality of articles to be dispensed one at a time comprising:

a dispenser body having an article storage chamber bounded by a plurality of panels including at least one soft-walled collapsible top panel, an opposing horizontally projecting bottom panel, a front panel an opposing rear panel;

an article extraction site having a portion projecting within at least the top panel and leading to the article storage chamber; and at least one stack of elongated articles of a predetermined length folded over at least once into a first planar section, a second planar section, and at least one curved section therebetween to define a folded article stack with each article of the folded article stack having a retrieval end pointing toward the rear panel, the folded article stack being disposed within the article storage chamber with at least one planar section adjacent and substantially parallel to the top panel, the other planar section resting on and projecting horizontally and substantially coextensively with the bottom panel and the planar sections defining a majority of the predetermined length of the elongated articles, and the at least one curved section disposed adjacent the front panel with the retrieval end of the outermost article of the folded article stack exposed through the extraction site, the outermost article being constructed to slide off the folded article stack without binding on an adjacent article and out through the extraction site in a substantially horizontal direction when pulled by its corresponding retrieval end with the soft-walled top panel collapsing following extraction of the outermost article to remain proximate the retrieval end of an adjacent article in the folded article stack wherein each article of the folded article stack may be selectively withdrawn one at a time in a substantially horizontal direction out through the extraction site by grasping a corresponding retrieval end and the soft-walled top panel collapses further with each article withdrawal until the innermost article is removed from the article storage chamber.

* * * * *